US012258751B2

(12) United States Patent
Wilson et al.

(10) Patent No.: US 12,258,751 B2
(45) Date of Patent: Mar. 25, 2025

(54) MODULAR BUILDING STRUCTURE

(71) Applicant: Jupe, Inc., Houston, TX (US)

(72) Inventors: Jeffrey Wilson, Boerne, TX (US); Remy Labesque, San Francisco, CA (US)

(73) Assignee: Jupe LLC, Kalispell, MT (US)

( * ) Notice: Subject to any disclaimer, the term of this patent is extended or adjusted under 35 U.S.C. 154(b) by 188 days.

(21) Appl. No.: 17/835,831

(22) Filed: Jun. 8, 2022

(65) Prior Publication Data

US 2023/0399840 A1 Dec. 14, 2023

(51) Int. Cl.
*E04B 1/343* (2006.01)
*E04H 1/12* (2006.01)
*E04H 15/48* (2006.01)

(52) U.S. Cl.
CPC ..... *E04B 1/34352* (2013.01); *E04B 1/343* (2013.01); *E04H 1/1205* (2013.01); *E04B 1/34317* (2023.08); *E04H 15/48* (2013.01)

(58) Field of Classification Search
CPC .. E04B 1/34352; E04B 1/343; E04B 1/34317; E04B 1/34336; E04H 1/1205; E04H 15/48
See application file for complete search history.

(56) References Cited

U.S. PATENT DOCUMENTS 2,701,038 A * 2/1955 Mooney ..... E04B 1/3445 52/143
3,157,185 A * 11/1964 Schoenike ..... E04H 15/48 D25/1
RE25,827 E * 8/1965 Bigelow ..... E04B 1/34336 52/64
3,398,850 A * 8/1968 Kennard ..... E04B 1/3445 217/14
3,560,042 A * 2/1971 McCarthy ..... B60P 3/34 296/26.02
3,575,460 A * 4/1971 Kennedy ..... B60P 3/38 5/8
3,768,855 A * 10/1973 Laue ..... E04B 1/3442 296/26.02
3,832,956 A * 9/1974 Briel, Jr. ..... E04B 1/3445 108/55.1

(Continued)

*Primary Examiner* — Gisele D Ford
(74) *Attorney, Agent, or Firm* — Cognition IP, P.C.; Edward Steakley; Justin White

(57) ABSTRACT

A modular building structure can include a rigid chassis, vertical support components, and wall and roof component(s). The chassis can have storage compartments formed therein and can provide a foundation and floor for the structure. The vertical support components can couple to the chassis to provide a vertical framework for the structure. The wall and roof component(s) can couple to the vertical support components. The vertical support components and wall and roof component(s) can be disassembled from the chassis and stored within the storage compartments. The chassis can include a horizontal bottom panel, vertically oriented crossbeams above the bottom panel, and horizontal top panels above the crossbeams to form the storage compartments. The vertical support components can be poles and the wall and roof component(s) can be cloth. Leveling feet coupled to the bottom of the chassis can allow the chassis to be leveled with respect to the ground.

20 Claims, 17 Drawing Sheets

(56) References Cited

U.S. PATENT DOCUMENTS 4,166,343 A * 9/1979 O'Brian ..... E04B 1/3445 296/173
4,742,653 A * 5/1988 Napier ..... E04B 1/3445 52/68
5,493,818 A * 2/1996 Wilson ..... E04B 1/3445 52/79.5
6,217,106 B1 * 4/2001 Reckner, Jr. ..... B60P 3/341 5/119
7,870,970 B2 * 1/2011 Fisk ..... B65D 88/022 220/4.28
8,613,166 B2 * 12/2013 Smith ..... E04B 1/3445 52/79.5
8,857,825 B1 * 10/2014 Johnson ..... E04H 15/08 280/19.1
10,465,376 B1 * 11/2019 Hoberman ..... E04B 1/35
11,130,437 B1 * 9/2021 Tatro ..... B60P 3/39
11,352,777 B2 * 6/2022 Chinn ..... E04B 1/34363
11,920,363 B2 * 3/2024 Elhart ..... E04H 15/008
2008/0209820 A1 * 9/2008 Muir ..... E04B 1/3445 52/79.5
2010/0025397 A1 * 2/2010 Krohn ..... B65D 88/522 220/6
2010/0186309 A1 * 7/2010 Hawkins ..... E04B 1/3445 52/79.5
2011/0290291 A1 * 12/2011 Neal ..... E04H 1/1244 135/144
2015/0218794 A1 * 8/2015 Martyn ..... E04B 1/343 52/79.5
2017/0051497 A1 * 2/2017 Kolbe ..... E04B 1/3445
2017/0335561 A1 * 11/2017 Wickramasekera .. E04H 1/1205
2018/0002915 A1 * 1/2018 De Visscher ..... A63H 33/04
2019/0112831 A1 * 4/2019 Attema ..... E04H 15/008
2019/0292806 A1 * 9/2019 Attema ..... E04H 15/48
2020/0071925 A1 * 3/2020 Shum ..... E04B 1/68
2020/0087939 A1 * 3/2020 Yuen ..... C08G 18/3218
2020/0391132 A1 * 12/2020 McInerney ..... E04H 15/62
2020/0392722 A1 * 12/2020 Chinn ..... E04B 1/34363
2021/0102398 A1 * 4/2021 Nead ..... E04H 15/34
2021/0324644 A1 * 10/2021 Dicks ..... E04H 15/008
2021/0404170 A1 * 12/2021 Hariri ..... E04B 1/34336
2023/0279691 A1 * 9/2023 Tsao ..... E04H 15/10 135/88.13
2023/0383565 A1 * 11/2023 Ko ..... E04H 15/54
2023/0399839 A1 * 12/2023 Kitagawa ..... B63B 35/44

* cited by examiner

MODULAR BUILDING STRUCTURE

TECHNICAL FIELD

The present disclosure relates generally to construction, and more particularly to building structures.

BACKGROUND

There are presently numerous challenges in the construction industry to provide enough building structures to meet the needs of society. There are building shortages in many regions, particularly with respect to suitable housing. Many people do not have adequate housing or any home at all, and homelessness is an increasing problem worldwide. Although there have been efforts to increase the number of buildings, and dwellings in particular, the production of housing has not kept up with demand in many areas.

Unfortunately, the cost to construct an average home is very high, and many simply cannot afford a basic home that meets their needs. Typical homes often require costly amounts of labor and materials to construct, are typically constructed on site, and are immobile and unmodifiable without significant amounts of added materials, labor, and cost. Furthermore, existing housing for those who are economically unable to procure a new home is often not enough, as older homes can be run down, require costly repairs and maintenance, are not readily modifiable at an affordable price, and may not meet the overall needs of their owners.

Although traditional ways of providing building structures have worked in the past, improvements are always helpful. In particular, what is desired are new building structures that are affordable, modifiable, and adaptable for dwelling for those who cannot afford other homes.

SUMMARY

It is an advantage of the present disclosure to provide new building structures that are affordable, modifiable, and adaptable for dwelling for those who cannot afford other homes. The disclosed features, apparatuses, systems, and methods provide modular building structures that are affordable, portable, readily constructible, and suitable for dwelling. These advantages can be accomplished at least in part by providing a modular building structure having a base configured to form a floor of the structure and to contain various building components and accessories, including at least the various items that can be readily removed and configured to form the walls, roof, and doors of the structure.

In various embodiments of the present disclosure, a modular building structure can include a rigid chassis, a plurality of vertical support components, and one or more wall and roof components. The rigid chassis can have a plurality of storage compartments formed therein and can provide a foundation and floor for the modular building structure. The plurality of vertical support components can be configured to be coupled to the chassis and provide a vertical framework for the modular building structure when the modular building structure is assembled. The plurality of vertical support components can also be configured to be disassembled from the chassis and stored within one or more of the plurality of storage compartments. The one or more wall and roof components can be configured to be coupled to the plurality of vertical support components and provide walls and a roof for the modular building structure when the modular building structure is assembled. The one or more wall and roof components can also be configured to be disassembled from the chassis and stored within one or more of the plurality of storage compartments.

In various detailed embodiments, the chassis can include at least one horizontally oriented bottom panel, a plurality of vertically oriented crossbeams situated above the bottom panel, and a plurality of horizontally oriented top panels situated above the crossbeams. The at least one bottom panel, plurality of crossbeams, and plurality of top panels can combine to form the plurality of storage compartments. One or more of the crossbeams can include at least one opening therein to facilitate storage of the plurality of vertical support components across multiple storage compartments within the chassis. The plurality of vertical support components can comprise poles configured to be arranged around a circumference of the chassis. The one or more wall and roof components can comprise a flexible material, which can be a cloth material.

In further detailed embodiments, the modular building structure can also include a plurality of leveling feet coupled to the bottom of the chassis. Such leveling feet can be configured to allow the chassis to be leveled with respect to the ground where the modular building structure is assembled. A plurality of support coupling components can be configured to couple the plurality of leveling feet to the chassis and can also be configured to couple the plurality of vertical support components to the chassis. Such support coupling components can be square tubes located at outer edges of the chassis, and/or other locations.

In still further detailed embodiments, the chassis can generally define a box shape, which can be about 8 feet wide by about 13 feet long by about 1.5 feet tall. At least one functional unit can be located within one or more of the storage compartments, and such functional unit(s) can be selected from the group consisting of an air conditioner, a heater, a mattress, and a computer. Also, a plurality of modular coupling components can be configured to couple the modular building structure to a separate similar modular building structure. The modular building structure can be configured to function as a bedroom and the separate similar modular building structure can be configured to function as an office, a kitchen, or a bathroom, among other possible units. In various arrangements, the modular building structure can be configured to be stacked with separate similar modular building structures, such as to be readily transported with the separate similar modular building structures and/or to be combined with other modular building structures in a vertical direction when deployed. The chassis can have upward, downward, and inward modularity.

In further embodiments of the present disclosure, various methods of deploying a modular building structure are provided. Pertinent process steps can include providing structural items of the modular building structure within a chassis, transporting the chassis to a building site, removing the structural items, and constructing the modular building structure. The structural items can be provided within one or more storage compartments of the chassis, which can be a rigid and self-contained unit. The chassis can provide a foundation and a floor for the modular building structure. Removing the structural items can involve removing them from the one or more storage compartments. Constructing the modular building structure can involve assembling the structural items onto the chassis.

In various detailed embodiments, the structural items can include a plurality of vertical support components that couple to the chassis to provide a vertical framework for the modular building structure and one or more wall and roof components that couple to the plurality of vertical support components to provide walls and a roof for the modular building structure. The chassis can include at least one horizontally oriented bottom panel, a plurality of vertically oriented crossbeams situated above the bottom panel, and a plurality of horizontally oriented top panels situated above the crossbeams. The at least one bottom panel, plurality of crossbeams, and plurality of top panels can combine to form the one or more storage compartments. In various arrangements, an additional process step can involve leveling the chassis with respect to the ground at the building site. In such arrangements, the structural items can include a plurality of leveling feet that are configured to be stored within the one or more storage compartments and that are also configured to couple to the bottom of the chassis to allow the chassis to be leveled.

Other apparatuses, methods, features, and advantages of the disclosure will be or will become apparent to one with skill in the art upon examination of the following figures and detailed description. It is intended that all such additional apparatuses, methods, features and advantages be included within this description, be within the scope of the disclosure, and be protected by the accompanying claims.

BRIEF DESCRIPTION OF THE DRAWINGS

The included drawings are for illustrative purposes and serve only to provide examples of possible structures and arrangements for the disclosed apparatuses, systems and methods of use regarding modular building structures. These drawings in no way limit any changes in form and detail that may be made to the disclosure by one skilled in the art without departing from the spirit and scope of the disclosure.

DETAILED DESCRIPTION

Exemplary applications of apparatuses, systems, and methods according to the present disclosure are described in this section. These examples are being provided solely to add context and aid in the understanding of the disclosure. It will thus be apparent to one skilled in the art that the present disclosure may be practiced without some or all of these specific details provided herein. In some instances, well known process steps have not been described in detail in order to avoid unnecessarily obscuring the present disclosure. Other applications are possible, such that the following examples should not be taken as limiting. In the following detailed description, references are made to the accompanying drawings, which form a part of the description and in which are shown, by way of illustration, specific embodiments of the present disclosure. Although these embodiments are described in sufficient detail to enable one skilled in the art to practice the disclosure, it is understood that these examples are not limiting, such that other embodiments may be used, and changes may be made without departing from the spirit and scope of the disclosure.

The present disclosure relates in various embodiments to features, apparatuses, systems, and methods for using modular building structures. The disclosed embodiments can include modular building structures that are affordable, modifiable, and adaptable for dwelling for those who cannot afford other homes, for example. These advantages can be accomplished at least in part by providing a modular building structure having a rigid and self-contained base or "chassis" configured to form a floor of the structure and to contain various building components and accessories, including at least the various items that can be readily removed and configured to form the walls, roof, and doors of the structure, among other structural features.

Such a modular building structure can be called a "jupe," which can be a relatively affordable, modifiable, and portable building unit that can be used as a dwelling and/or for a variety of other building functions. Such jupes can be readily and quickly assembled, disassembled, transported, and reassembled as self-contained units. Although various embodiments disclosed herein discuss the provided modular building structures as housing or dwelling units, it will be readily appreciated that the disclosed features, apparatuses, systems, and methods can similarly be used for other purposes as may be desired. In various detailed examples, which are merely illustrative and non-limiting in nature, the disclosed jupes can function as bedrooms or other sleeping quarters, as well as offices, kitchens, bathrooms, or other types of building units. Other applications, arrangements, and extrapolations beyond the illustrated embodiments are also contemplated.

Figure 1:
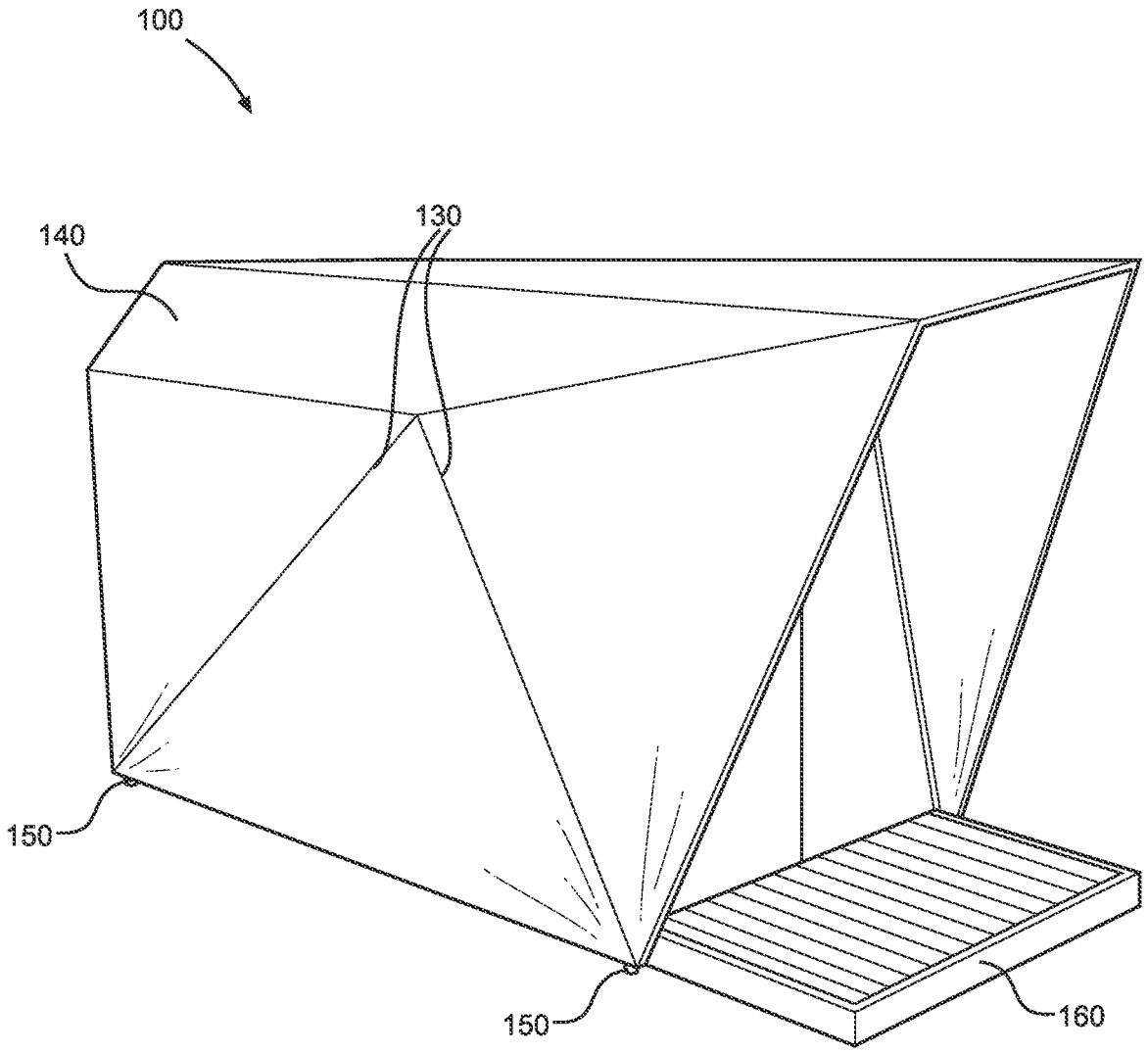
FIG. 1 illustrates in front perspective view an example modular building structure according to one embodiment of the present disclosure.
Figure 2A:
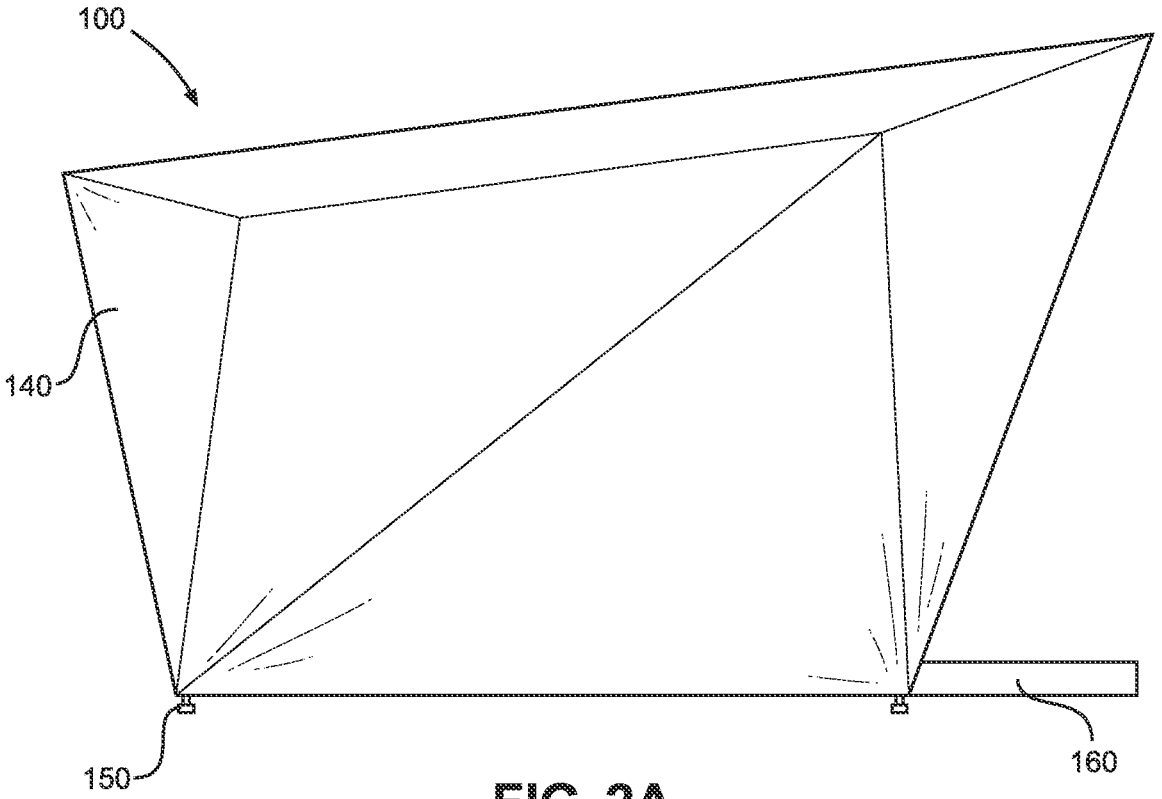
FIG. 2A illustrates in side elevation view the modular building structure of FIG. 1 according to one embodiment of the present disclosure.
Figure 2B:
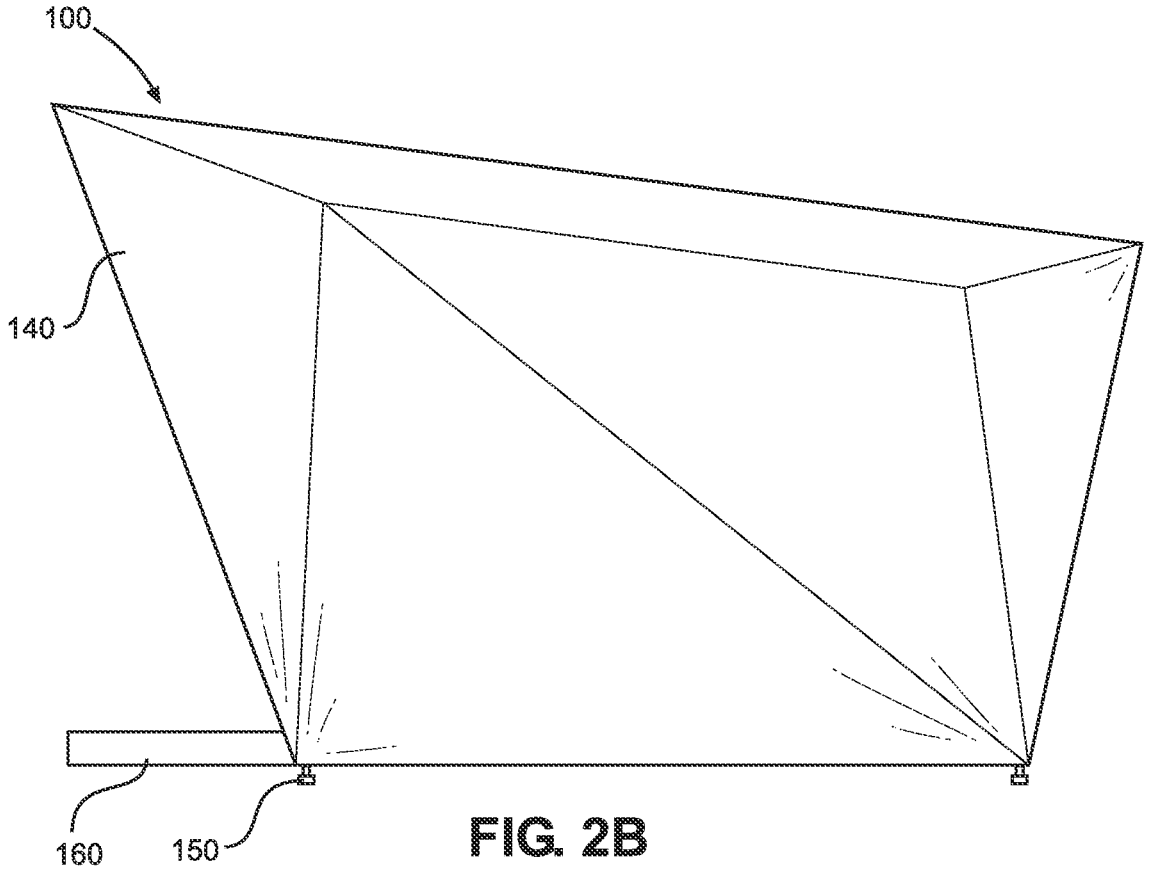
FIG. 2B illustrates in obverse side elevation view the modular building structure of FIG. 1 according to one embodiment of the present disclosure.
Figure 2C:
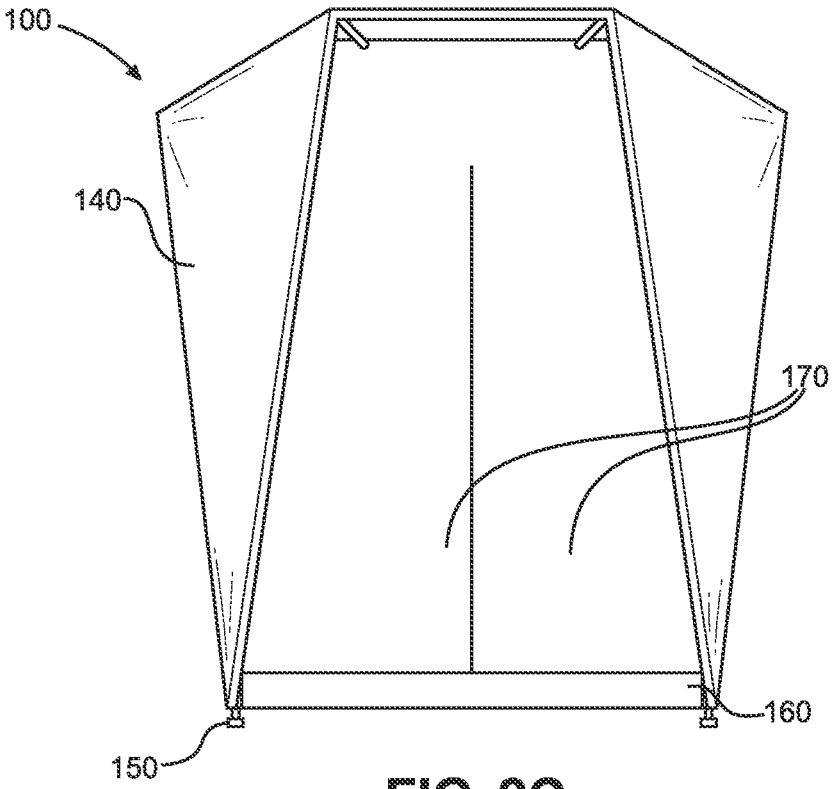
FIG. 2C illustrates in front elevation view the modular building structure of FIG. 1 according to one embodiment of the present disclosure.
Figure 2D:
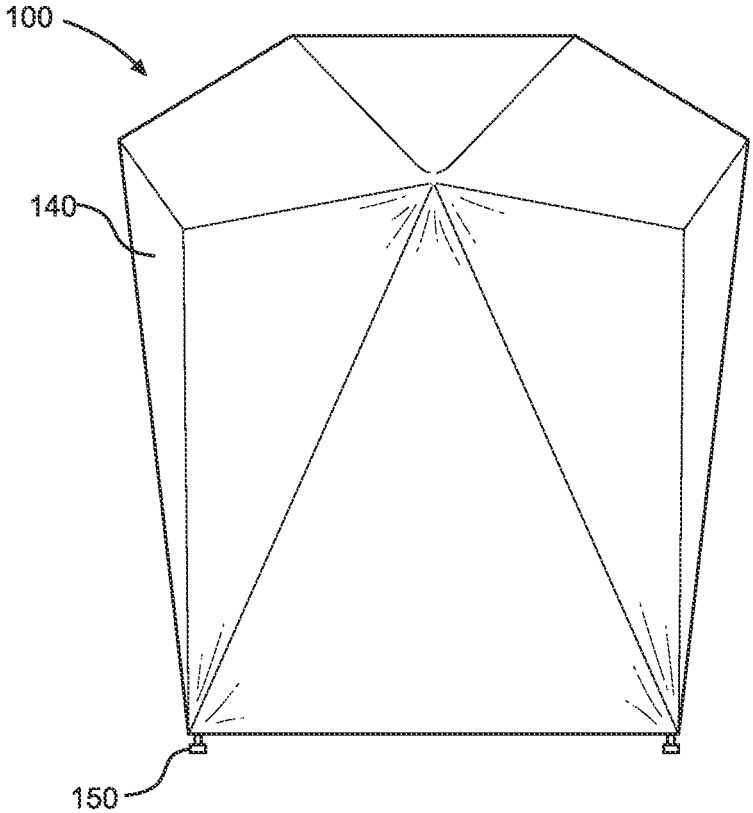
FIG. 2D illustrates in rear elevation view the modular building structure of FIG. 1 according to one embodiment of the present disclosure.
Figure 2E:
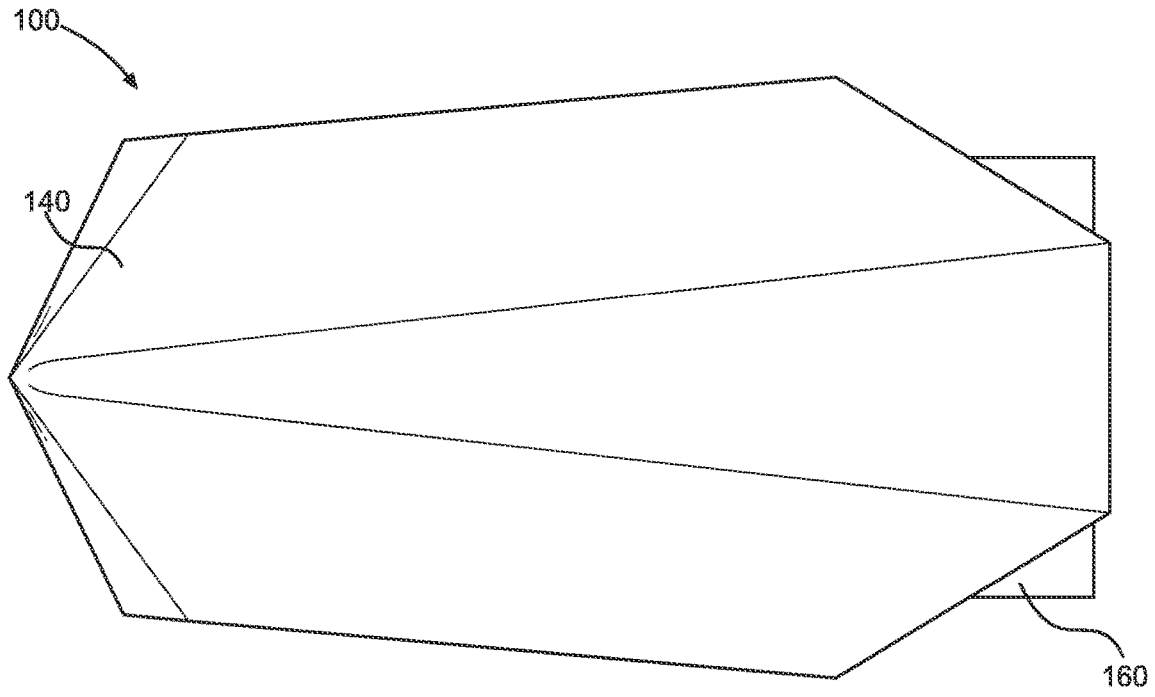
FIG. 2E illustrates in top plan view the modular building structure of FIG. 1 according to one embodiment of the present disclosure.
Figure 2F:
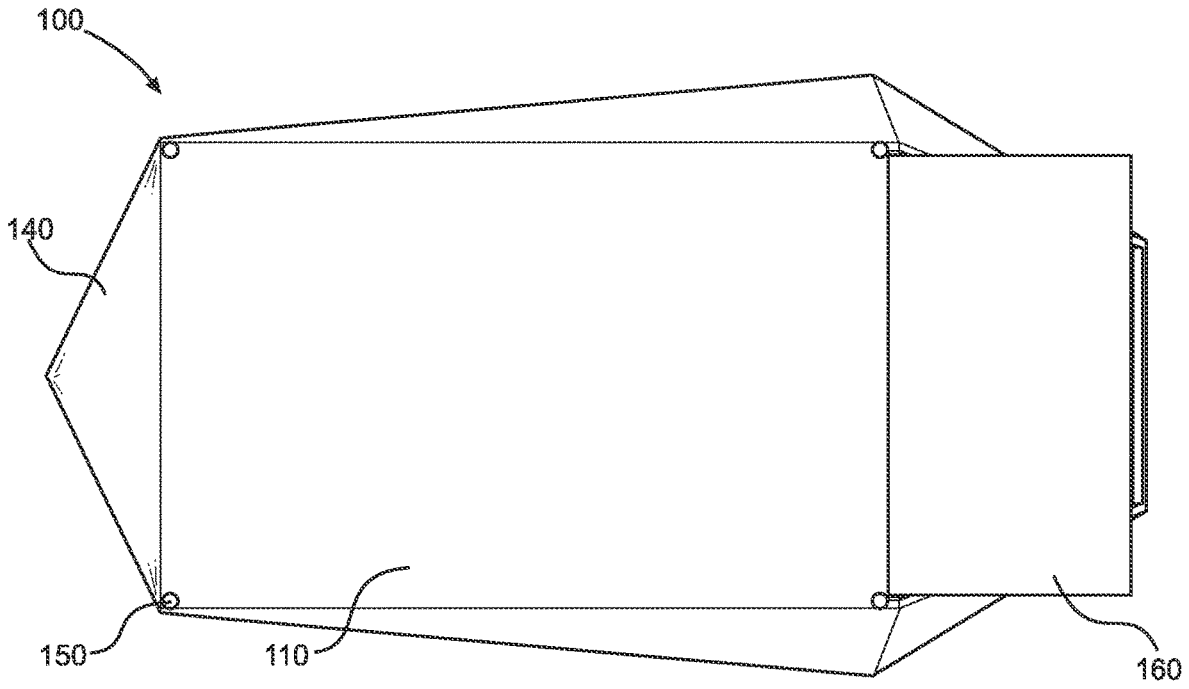
FIG. 2F illustrates in bottom plan view the modular building structure of FIG. 1 according to one embodiment of the present disclosure.

Referring first to FIG. 1, an example modular building structure according to one embodiment of the present disclosure is illustrated in front elevation view. Modular building structure (i.e., "jupe") 100 can generally include a rigid base or "chassis" (shown as 110 below), a plurality of vertical support components 130, one or more wall or roof components 140, and leveling feet 150, among other various components. Additional items can include a front porch 160, for example, which may be coupled to the front the of chassis.

Continuing with FIGS. 2A through 2F, modular building structure 100 is shown in side elevation, obverse side elevation, front elevation, rear elevation, top plan, and bottom plan views respectively. These views simply provide additional context for the relative locations, shapes, and sizes of the various features of modular building structure 100. Additional features can include, for example, one or more doors 170, which can be located at the front of the structure behind the porch 160 and which can be separate from or formed as part of the one or more wall or roof components 140. In various arrangements, chassis 110 can be a rigid component, while one or more wall or roof components 140 can be a flexible material. For example, one or more sheets of canvas or other cloth material can be used to form all of the wall and roof components 140. Alternatively, or in addition, one or more rigid materials can be used to form one or more wall and roof components 140. Such materials can include, for example, fiberglass, wood, sheet metal, and/or plastic, among other possible materials.

Figure 3:
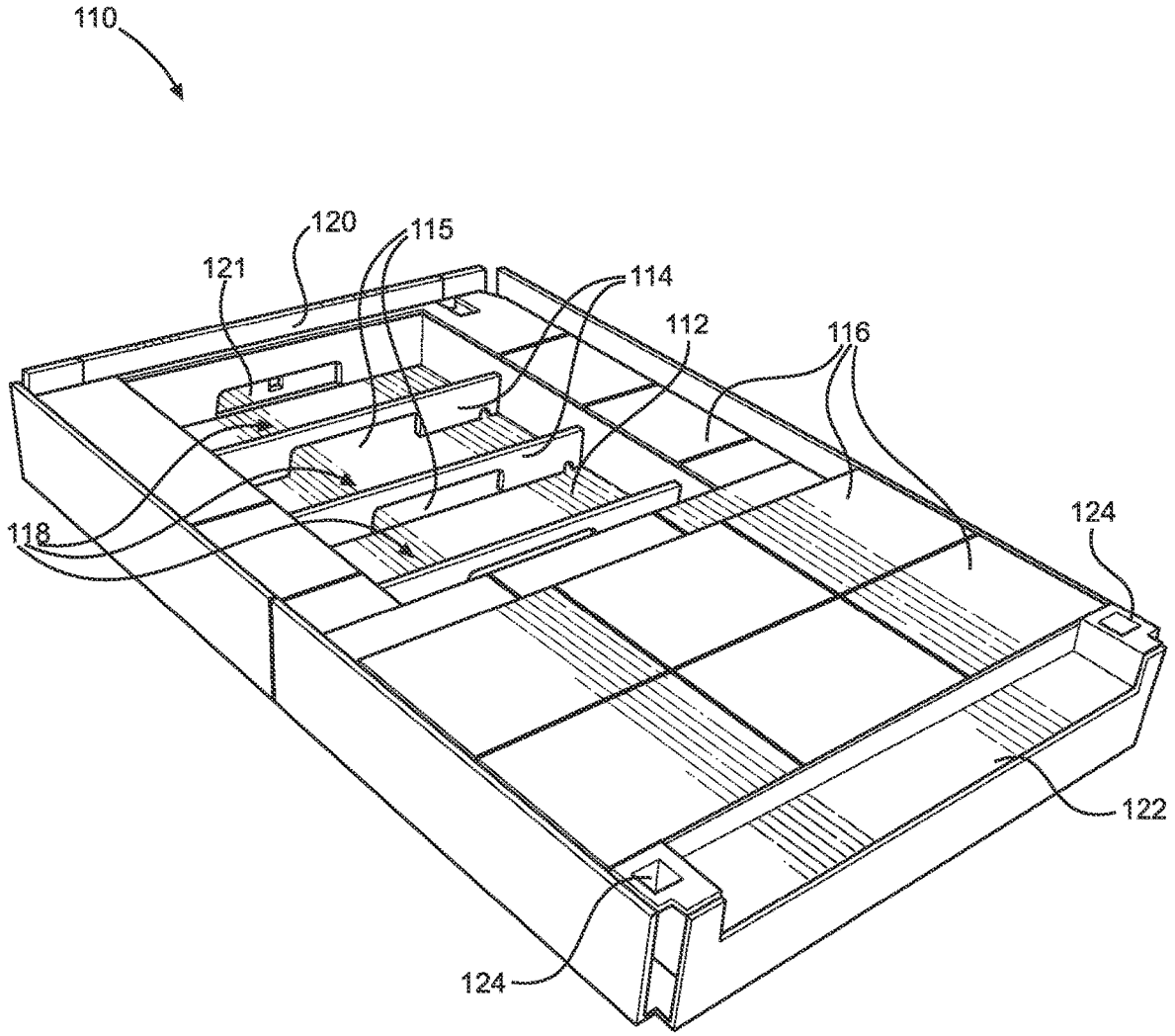
FIG. 3 illustrates in front perspective view an example rigid chassis for a modular building structure according to one embodiment of the present disclosure.

Turning next to FIG. 3, an example rigid chassis for a modular building structure is shown in front perspective view. Chassis 110 can provide a foundation and floor for the overall modular building structure. It is specifically contemplated that chassis 110 be sized and shaped such that it can be readily and easily transported with other same or similar chassis. For example, multiple chassis 110 can be stacked together and transported on the same truck, trailer, or other vehicle. As such, chassis 110 can generally define a box shape in some arrangements, although other shapes are also possible. Chassis 110 can be about 8 feet wide by about 13 feet wide by about 1.5 tall, although other dimensions are also certainly possible.

In various embodiments, chassis 110 can have upward, downward, and inward modularity. Upward modularity can involve the various ways that upper supports, such as vertically oriented crossbeams for example, other wall components, roof components, and other components can extend upward from chassis 110. Downward modularity can involve the various ways that lower supports, such as leveling feet for example, other lower supports, straight or curved profiles, stacking components, mounts, and other components can extend downward from chassis 110. Inward modularity can involve the various ways that internal components and compartments can extend inwards from the outer walls of chassis 110.

As shown, chassis 110 can include at least one horizontally oriented bottom panel 112, a plurality of vertically oriented crossbeams 114 situated above the bottom panel, and a plurality of horizontally oriented top panels 116 situated above the crossbeams. In various arrangements, the bottom panel(s) 112, crossbeams 114, and top panels 116 can combine to form a plurality of storage compartments 118 within chassis 110. One or more of crossbeams 114 can have openings 115 formed therein, which openings can allow passage between multiple storage compartments 118. This can allow for the storage of vertical support components, such as poles, across multiple storage compartments 118, for example. Openings between multiple storage compartments may also exists to facilitate the storage or location of other large items, such as electronic equipment and/or water or other fluid storage tanks, for example.

Chassis 110 can also include a back board 120 at a back end of the chassis, which may have a door 121 or other opening therein. Opening or removal of door 121 can allow for removal of various items, such as poles or other vertical support components, from one or more of the storage compartments 118. Chassis 110 can also include a front step 122, which can be sized and shaped for the installation of a porch or other step component or feature at a front end of the chassis.

In various arrangements, chassis 110 can include one or more features around its circumference that allow for coupling of support components to the chassis. For example, openings 124 located at the corners of chassis 110 can be configured to accommodate support coupling components thereto. Such support coupling components can couple vertical support component to chassis 110 at a top side thereof and can also couple leveling feet to the chassis at a bottom side thereof. These support coupling components can be, for example, square metal tubes configured to couple poles or other vertical support components to the top side of the tube and leveling feet to the bottom side of the tube. Circular tubes may also be used in some cases. Other shapes, materials, and arrangements can be used for such support coupling components. While such support coupling components can be located around the outer edges of chassis 110, it will be appreciated that one or more other locations about chassis 110 may be used alternatively or in addition for facilitating coupling with various support coupling components.

Figure 4A:
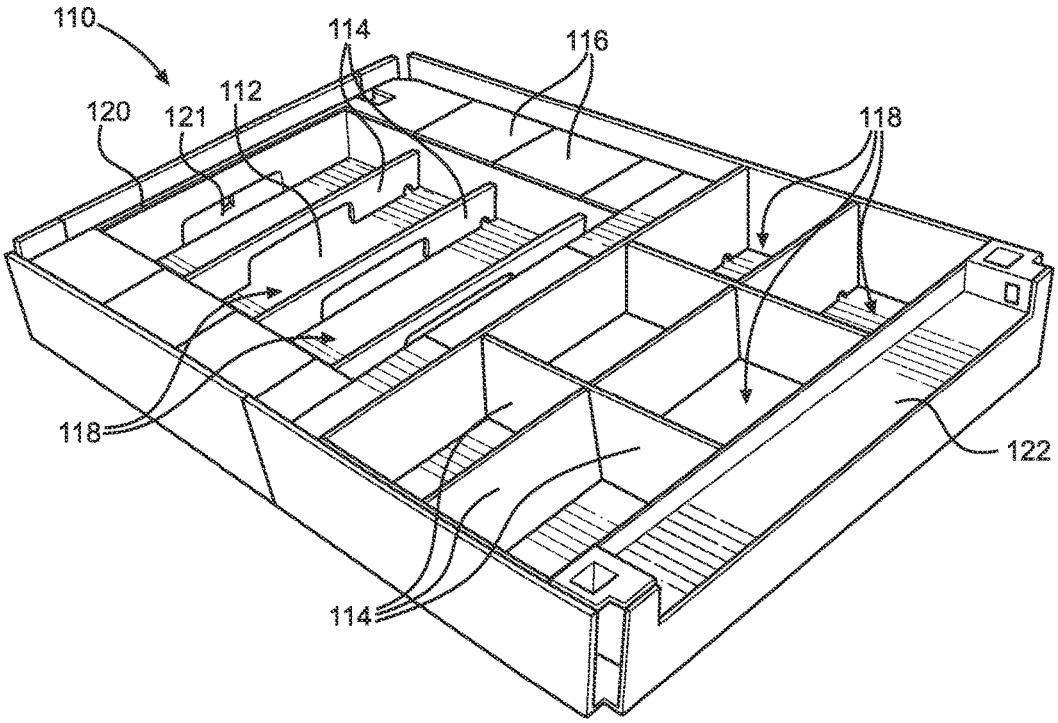
FIG. 4A illustrates in front perspective view the rigid chassis of FIG. 3 with multiple top panels removed according to one embodiment of the present disclosure.
Figure 4B:
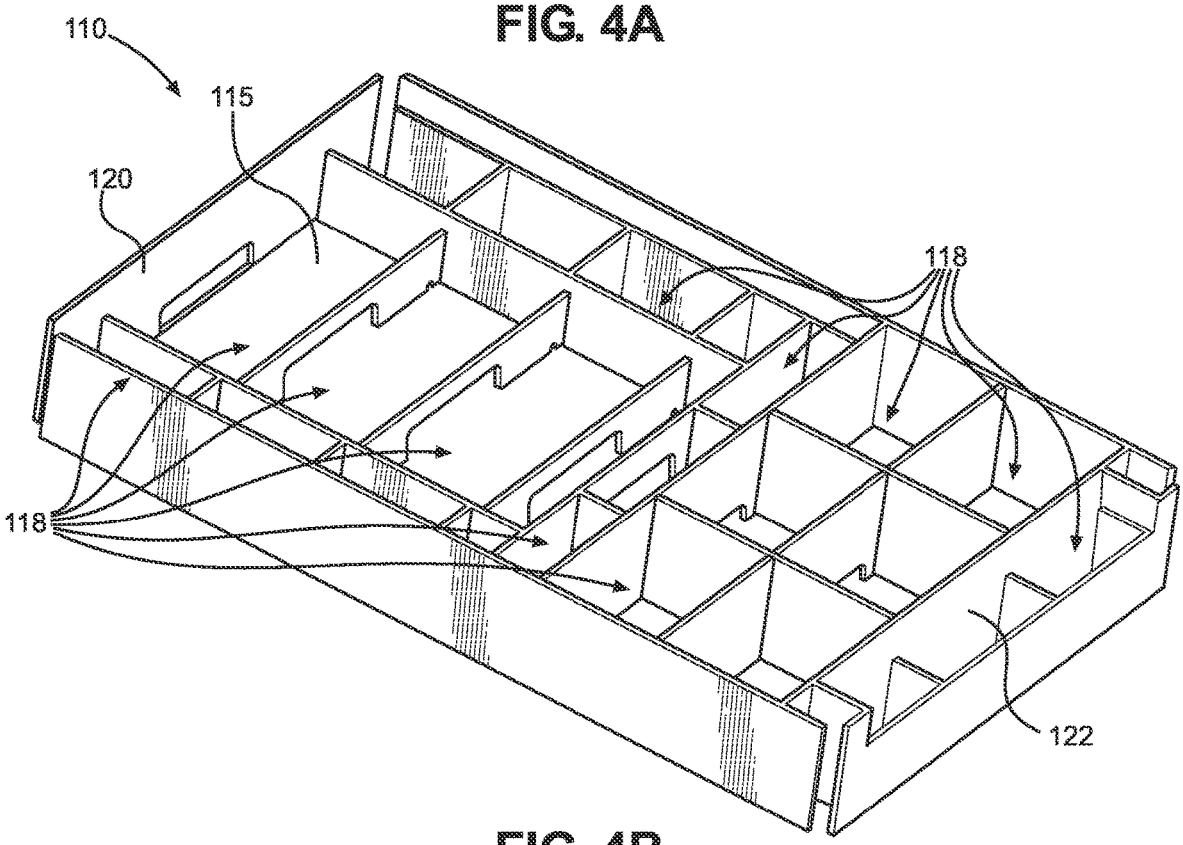
FIG. 4B illustrates in front perspective view the rigid chassis of FIG. 3 with all top panels removed according to one embodiment of the present disclosure.

Continuing with FIGS. 4A and 4B, the rigid chassis of FIG. 3 is shown in front perspective views with multiple top panels removed and all top panels removed respectively. In FIG. 4A, top panels 116 have been removed from several of the storage compartments 118 toward the front of chassis 110 to reveal these storage compartments and their respective crossbeams 114. In FIG. 4B, all of the top panels have been removed to reveal more of the crossbeams 114 and more of the various storage compartments 118 within chassis 110. As shown, there can be storage compartments 118 throughout chassis 110, such as in the front, along the sides, in the middle, and even beneath the porch or front step 122.

In various embodiments, the various other structural components used to form the overall modular building structure can fit within these various storage compartments 118. For example, the vertical support components, which can be poles, leveling feet, wall and roof components, and other structural components can all be stored within the storage compartments 118 located at the center of chassis 110 and can be accessed through opening or door 121. Placing all of these components within chassis 110 can allow for the ready transport of the overall modular building structure. Fitting all of these components into chassis 110 with its top panels 116 installed can also facilitate the ready stacking of multiple chassis together for ease of transport of many modular building structures. Other components and/or functional items may also be stored within the various storage compartments, such as an air conditioner, heater, mattress, computer, computer routers, WiFi network components, cryptocurrency mining equipment, heated floor tiles, batteries, soil, plants, grain and/or other food items, fuel, fuel cells, pressurized air and/or other gaseous state materials, water treatment equipment, fresh, black, and/or grey water tanks, and/or numerous other items, as will be readily appreciated.

In various embodiments, the bottom panel(s), crossbeams, top panels, and other components of chassis 110 can be formed of a rigid material, such as wood, metal, a hard plastic, or other suitable construction material. These components can be mass produced, such as by metal or plastic extrusion, sheet metal stamping, welding, cutting using a CNC system, fiberglass formation processes, three-dimensional printing, and/or material press forming processes, for example, among various other suitable component formation processes and techniques. The panels and crossbeams can be coupled together in a way that allows for the ready removal or reassembling of components, such as by screws, bolts, latches, or other suitable coupling components. In various arrangements, the various panels and crossbeams of chassis 110 can be arranged and supported by interconnected tongue and groove slotted arrangements, although other suitable coupling and supporting mechanisms can be used.

Figure 5:
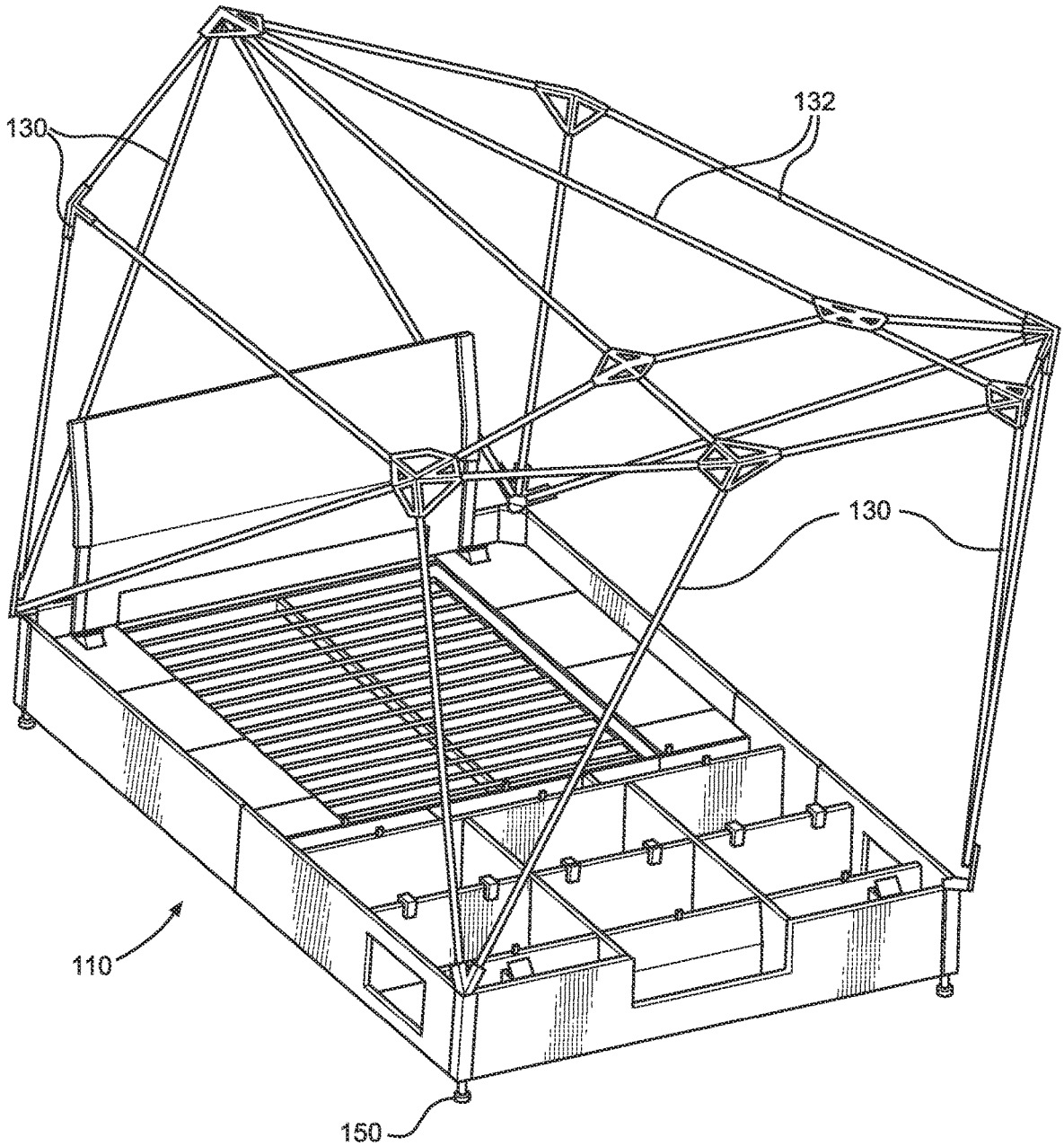
FIG. 5 illustrates in front perspective view an example rigid chassis and vertical support component combination for a modular building structure according to one embodiment of the present disclosure.

Turning next to FIG. 5, an example rigid chassis and vertical support component combination for a modular building structure is illustrated in front perspective view. As shown, multiple vertical support components 130 can be installed around the circumference of chassis 110, such as at the corners of a box shaped chassis. Vertical support components 130 can be used to provide support for the walls and roof of the overall modular building structure. Vertical support components can be poles, for example, and can be formed of a rigid material, such as metal or a hard plastic, among other suitable materials.

In addition, multiple top support components 132 can be installed across the top of the overall structure. Top support components 132 can be coupled to vertical support components 130 as well as each other. Top support components 132 can also be formed of a rigid material and can be the same or similar to vertical support components 130. As shown, chassis 110, vertical support components 130, and top support components 132 can combine to define the overall shape of the modular building structure, as walls, a roof, and other components can then be added to this overall frame generally formed by the chassis and support components. Leveling feet 150 can be located beneath chassis 110 at each of the corners of the chassis.

Figure 6:
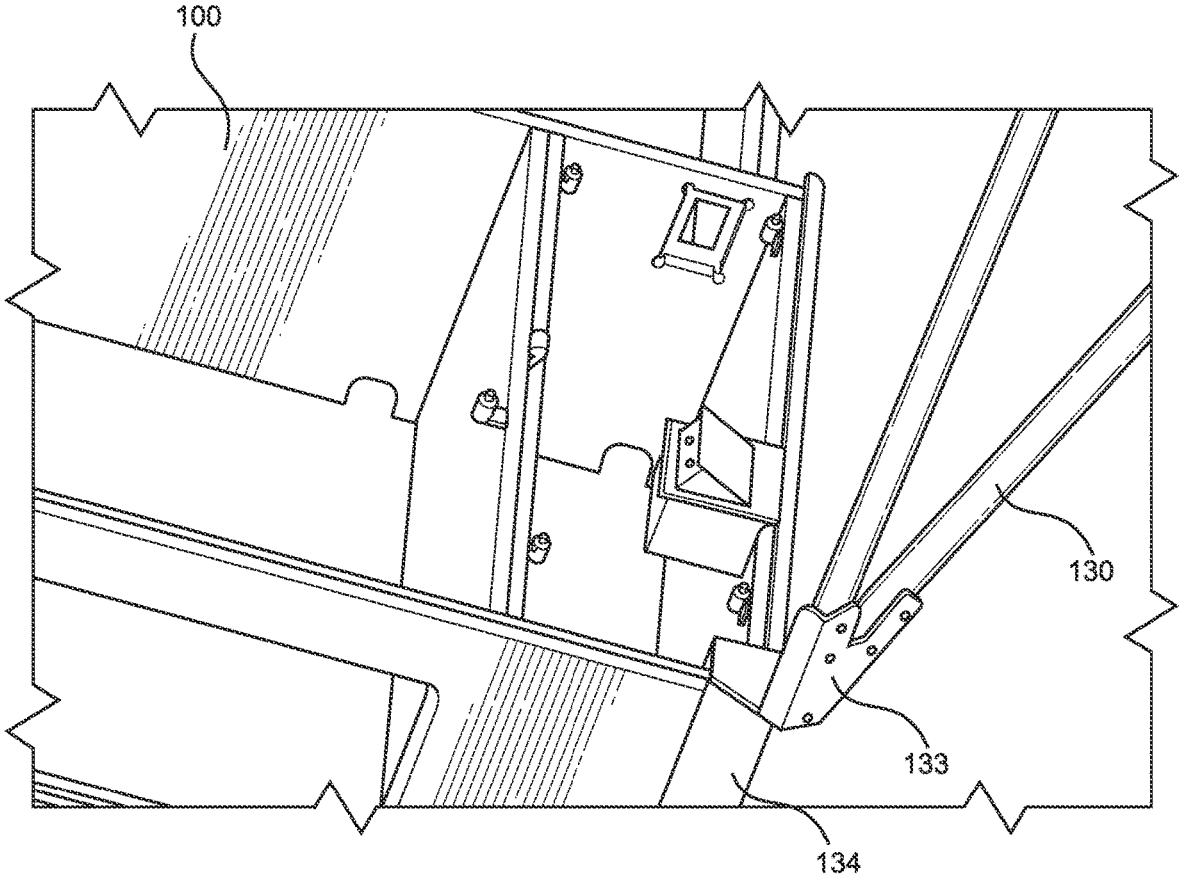
FIG. 6 illustrates in side perspective view an example set of vertical support components coupled to a rigid chassis for a modular building structure according to one embodiment of the present disclosure.

Continuing with FIG. 6, an example set of vertical support components coupled to a rigid chassis for a modular building structure is shown in side perspective view. As shown, multiple poles or other vertical support components 130 can couple to a corner of chassis 100. This can be accomplished by coupling vertical support components 130 to a vertical support component to chassis bracket 133, which is in turn coupled to support coupling component 134, which again can be a metal tube inserted into an opening at the corner of chassis 110. This arrangement can be repeated at each of the corners of chassis 110.

Figure 7A:
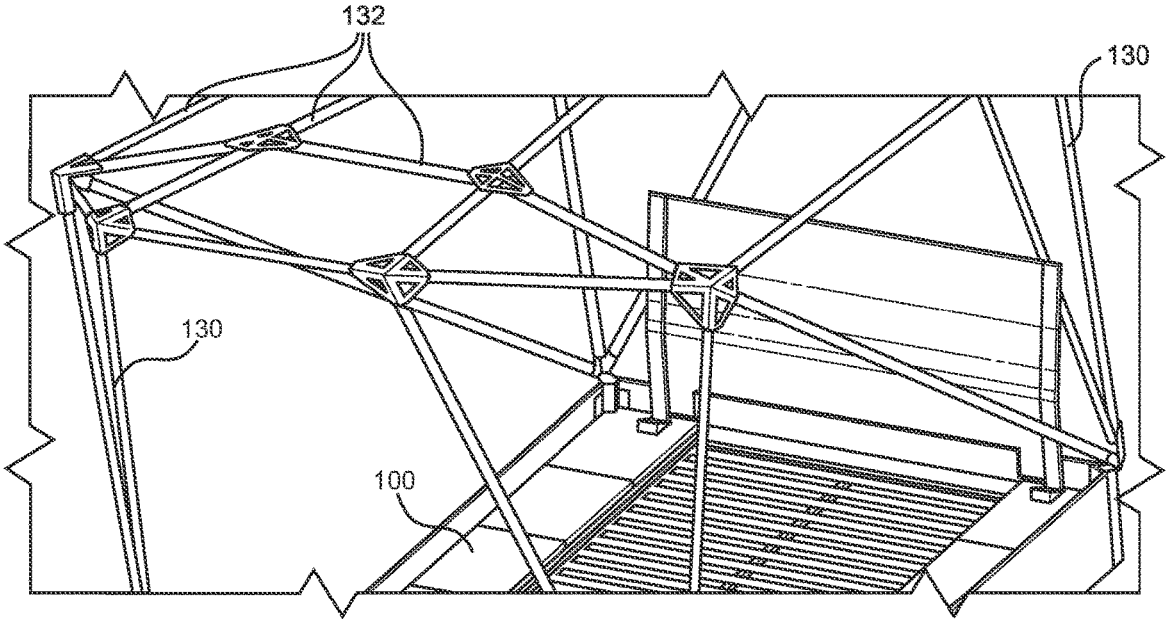
FIG. 7A illustrates in top perspective view an example set of top support components coupled to a set of vertical support components coupled to a rigid chassis for a modular building structure according to one embodiment of the present disclosure.
Figure 7B:
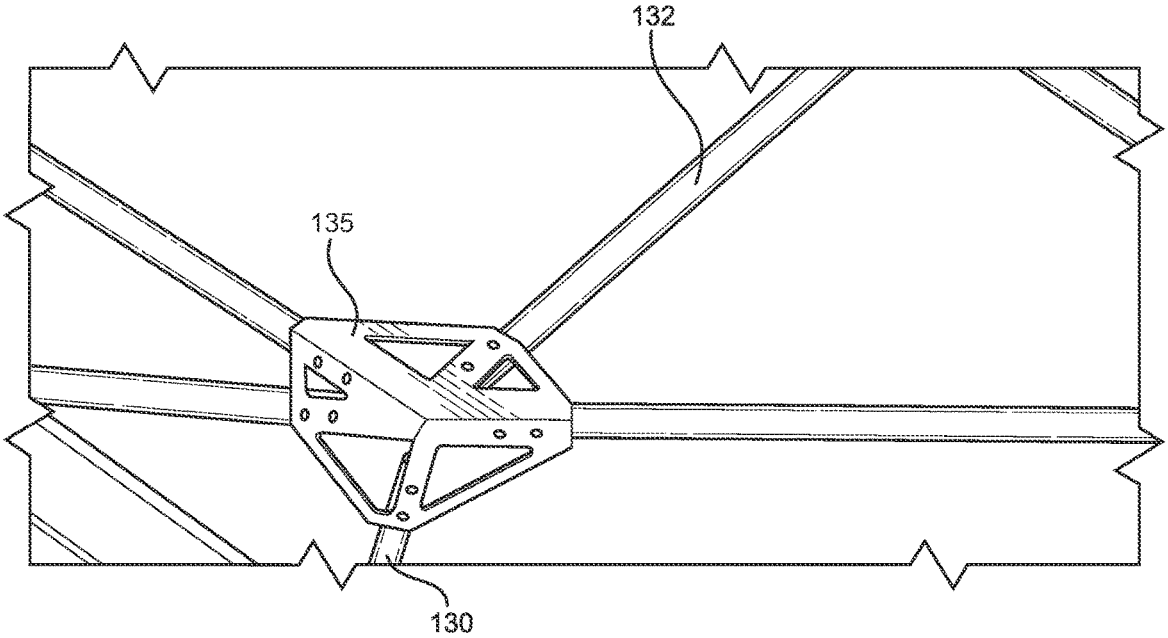
FIG. 7B illustrates in top perspective view an example coupling arrangement for coupling a set of top support components to a set of vertical support components for a modular building structure according to one embodiment of the present disclosure.

Next, FIGS. 7A and 7B illustrate in top perspective views an example set of top support components coupled to a set of vertical support components coupled to a rigid chassis for a modular building structure and an example coupling arrangement for coupling a set of top support components to a set of vertical support components for a modular building structure. Again, vertical support components 130, which can be poles, can be coupled to chassis 110, and in turn top support components 132, which can also be poles, can be coupled to the vertical support components. Such a coupling arrangement can include the use of a top support component to vertical support component bracket 135. Carriage bolts, screws, or other suitable coupling items can be used to facilitate these bracket couplings, as will be readily appreciated.

While various examples have been provided herein regarding a chassis 110, vertical support components 130, top support components 132, and wall and roof components 140, it will be readily appreciated that wall and roof components 140 can also provide the function of vertical support components 130 and/or top support components 132 in some arrangements. For example, where one or more rigid materials are used to form one or more wall and roof components 140, such materials can serve to provide adequate support for the overall wall and/or roof structures themselves. Again, such rigid materials can include, for example, fiberglass, wood, sheet metal, and/or plastic, among other possible materials. Accordingly, the use of poles or other skeletal support components may not be necessary in all arrangements.

Figure 8:
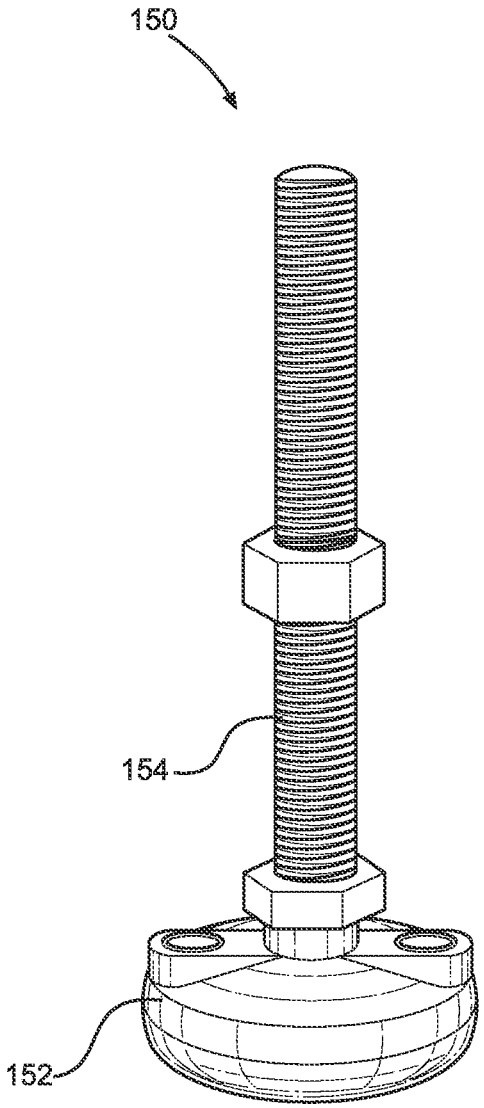
FIG. 8 illustrates in front elevation view an example leveling foot for a modular building structure according to one embodiment of the present disclosure.

FIG. 8 illustrates in front elevation view an example leveling foot for a modular building structure. As noted above, a plurality of leveling feet 150 can be coupled to the bottom of the chassis, and each of these leveling feet can be configured to allow the chassis to be leveled with respect to the ground where the modular building structure is assembled. Leveling feet 150 can be installed beneath the chassis at each corner of the chassis to facilitate the ready leveling of the overall modular building structure. Each leveling foot 150 can include various components to allow for such leveling. For example, leveling foot 150 can have a bottom platform 152 coupled to a threaded shaft 154 in an arrangement that allows the leveling foot to be raised or lowered up the shaft by rotating the bottom platform along the shaft. By adjusting each of the leveling feet 150 at the corners of the chassis to be raised or lowered as needed with respect to the ground at that corner, the overall modular building structure can be readily and easily leveled. Other leveling feet arrangements are also contemplated, and such other arrangements can include the ability of the bottom platform or other ground contact to tilt or swivel as needed.

It will be readily appreciated that leveling feet or other similar leveling components are just one possible feature that can be located beneath a chassis 110 of an overall modular building structure 100. In fact, numerous other components and items can be located within a downward modularity direction of a given structure. Leveling feet and other such components and items can be referred to as undercarriage or underchassis components, and such components can provide various functions for a given chassis and overall modular building structure.

In various embodiments, underchassis components that can be included beneath a chassis of a modular building structure can allow the chassis to readily sit on a trailer or other shipping vessel, can allow the chassis to be mounted within a treehouse platform, can allow the chassis to be placed on a pontoon or boat structure, can provide an air boat fan, one or more magnets, and/or one or more hydrofoils for a levitation or swamp boat adaptation, and/or can form wheels or allow wheels to be mounted beneath the chassis to facilitate ready chassis movements both for transport and for simple or slight movements of the chassis and/or overall structure after a partial or full deployment. Other various components, adaptations, and functions can be provided by way of including or customizing one or more underchassis components that form or couple to the chassis in various structural arrangements. Of course, multiple components and features can be provided for a given chassis in some embodiments.

In various further arrangements, downward mobility with respect to a given chassis can also include the ability to stack multiple chassis together as part of a fully deployed structure. For example, a triple stacked modular building structure can include a top level chassis that serves as an overall living structure, such as a bedroom, for example, a middle level chassis that serves as a power unit, such as a collection of batteries, other power components, and/or wiring and electrical equipment that fill or substantially fill an entire chassis, and a bottom level chassis that serves as a water storage or plumbing unit. Each chassis in such a stacked arrangement can be configured to be coupled to other chassis above and/or below it. In the triple stacked modular building structure provided above, the top level living chassis can have an underchassis that is configured to be coupled at various strategic locations to the middle level power source chassis, which in turn can have an underchassis that is configured to be coupled at various strategic locations to the bottom level water storage or plumbing chassis. Of course, two, four, or more chassis may be similarly stacked to form a single overall combined structure, and various other functions can be inherent to any given chassis within such an overall combined structure.

Figure 9A:
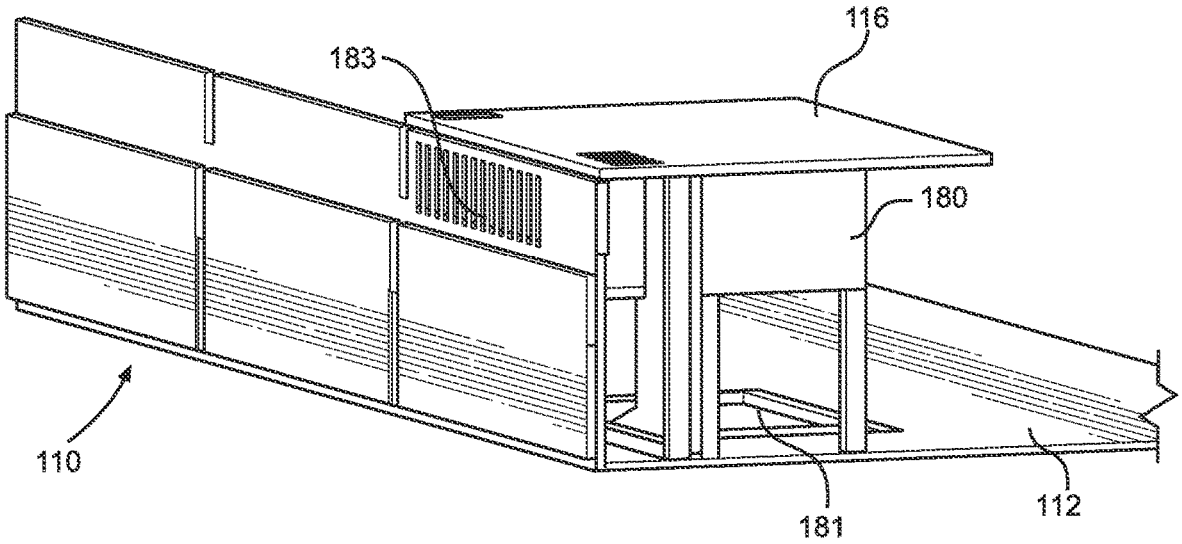
FIG. 9A illustrates in front perspective view an example functional unit located within a storage compartment of a rigid chassis for a modular building structure according to one embodiment of the present disclosure.
Figure 9B:
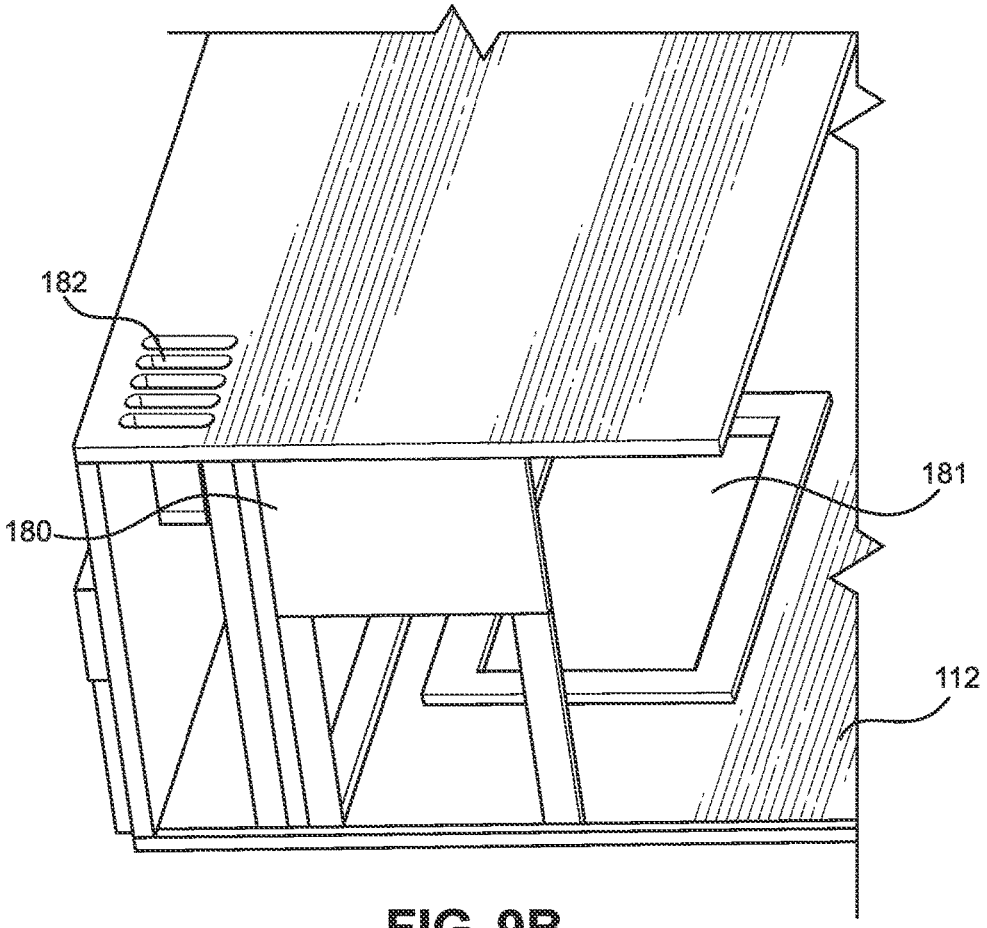
FIG. 9B illustrates in top perspective view the functional unit of FIG. 8A according to one embodiment of the present disclosure.

As noted above, one or more functional units can be located within the various storage compartments of the chassis of the disclosure modular building structure. FIGS. 9A and 9B illustrate an example of one such functional unit in front perspective and top perspective views respectively. As shown, functional unit 180 can be located between top panel 116 and bottom panel 112, which combine to from a storage compartment within chassis 110. Multiple functional units can be included within multiple storage compartments of chassis 110, and functional units can include, for example, air conditioners, heaters, mattresses, computers, plumbing features, batteries or other power sources, and other possible items.

Functional unit 180 in FIGS. 9A and 9B can be, for example, an air conditioner. In some arrangements, various features can be formed within chassis 110 to accommodate the particular type of functional unit to be located within a given storage compartment. For example, in the event of an air conditioner, heater, or other environmental control component requiring air flow, an air duct 181 can be formed in bottom panel 112, a first set of vent holes 182 can be formed in top panel 116, and a second set of vent holes 183 can be formed in the sidewall of chassis 110. Each of these customized features can be arranged to facilitate the flow of air for an air conditioner as the functional unit 180 located in the storage compartment shown.

Figure 10:
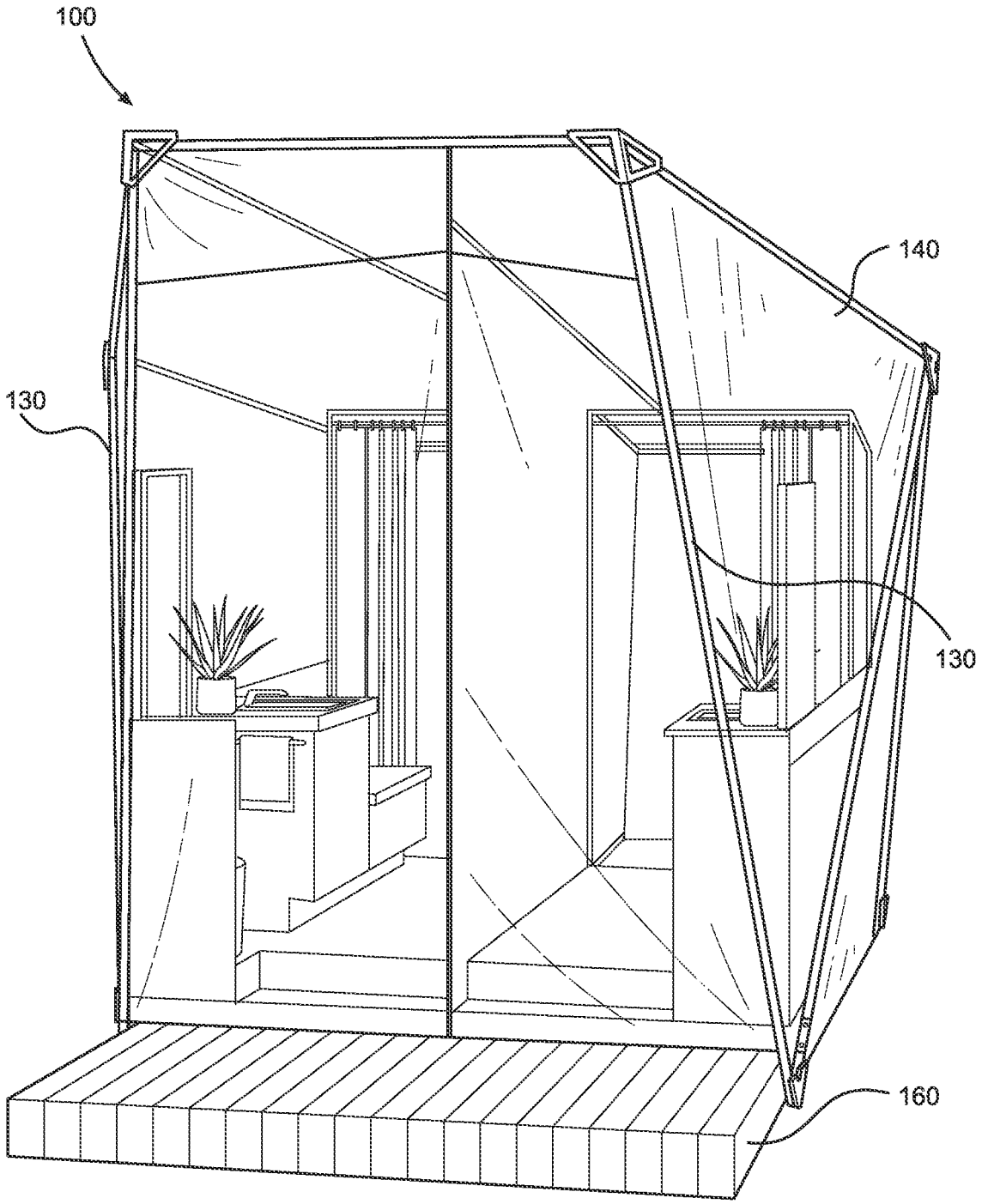
FIG. 10 illustrates in front perspective view an example fully assembled single modular building structure according to one embodiment of the present disclosure.

FIG. 10 illustrates in front perspective view an example fully assembled single modular building structure. After the outer support components are formed atop the chassis of the overall structure, as shown in FIG. 5, then one or more wall and roof components can be assembled around the outer support components. Again, outer support components of modular building structure 110 can include vertical support components 130 and top support components 132, as shown above in FIG. 5, and wall and roof components 140 can be formed around these, such as by using a one or more sheets of canvas or other cloth or flexible material, for example. In other embodiments, other materials can be used to form the walls and roof of the modular building structure 100 around the support frame. Such materials can include, for example, sheets of plastic, metal panels, or the like. Preferably, whatever materials are used for the walls and roof of overall structure 100 can be disassembled at placed within the chassis of the structure. A front porch 160 and/or other possible components and features can also be included in a fully assembled modular building structure 100, as will be readily appreciated.

Figure 11:
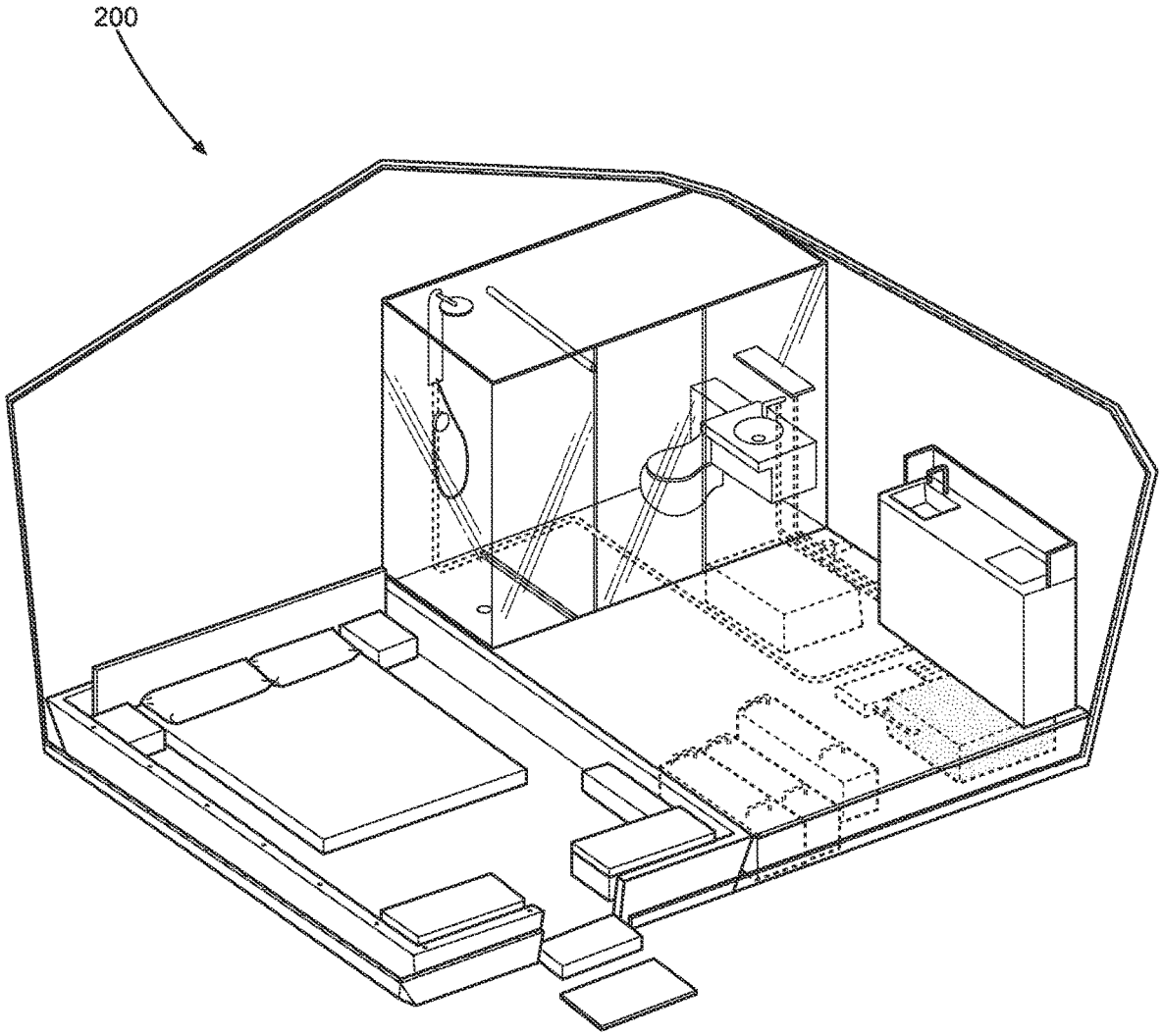
FIG. 11 illustrates in front perspective view an example fully assembled double modular building structure according to one embodiment of the present disclosure.

In various arrangements, multiple modular building structures as disclosed herein can be coupled to each other. This can result in multiple structures combining to form a larger structure having multiple rooms or sections at the building site. FIG. 11 illustrates in front perspective view an example fully assembled double modular building structure. Double modular building structure 200 can be formed using two separate chassis and two separate sets of structural building components, which can be stored within each respective chassis for transport and then assembled atop each respective chassis to form its own building structure. Both building structures can then be combined to form double modular building structure 200, which can be, for example, a bedroom chassis and structure coupled to a bathroom chassis and structure, as shown. Additional components used to facilitate such a double structure can include a plurality of modular coupling components configured to couple a first modular building structure to a separate similar second modular building structure. This can be accomplished, for example, by having such modular coupling components located at the sides and/or corners of each separate chassis to facilitate interconnection between multiple chassis.

As will be readily appreciated, multiple modular building structures can be coupled together as shown in FIG. 11 in ways that involve more than just two modular building structures. For example, two additional modular building structures can be coupled to the double modular building structure 200 shown in FIG. 11 to form an even larger overall combined structure. Such additional modular building structures could be, for example, a kitchen chassis and structure as well as an office chassis and structure, which can then result in a quadruple modular building structure of a bedroom, bathroom, kitchen, and office. Still further modular building structures can be combined together in the same or similar manners, such that overall combined structures can include any number of modular units from 2 to 10 or even more than 100 or 1,000 individual modular units with separate chassis and structures combined into an overall structure. In addition to bedrooms, bathrooms, kitchens, and/or offices, other types of modular building structures can include, for example, living rooms, medical rooms, playrooms, greenhouse or plant rooms, power units, electronics rooms, communications rooms, storage rooms, and/or the like, among other possible structures.

In addition to being coupled side by side and/or front to back, various modular building structures can also be coupled in a stacked manner, such as where an office module can be coupled or stacked atop one or more electronics and/or power modules. Alternatively, or in addition, a bathroom module may be coupled or stacked atop one or more plumbing and/or water storage or processing modules. In some arrangements, one or more modules may be coupled side by side to one or more other modules as well as coupled to one or more other modules in upward and/or downward directions. For example, four modules coupled laterally to form an overall bedroom, bathroom, kitchen, office overall structure may also have pontoon or boat modules coupled beneath each module such that the overall structure forms an eight module structure that can be waterborne. Other arrangements are also contemplated.

In some arrangements, multiple chassis may be coupled side by side and/or stacked vertically to form an overall multi-module structure, while one or more chassis may then be rotated vertically to couple to the sides and/or wall components of other structures. Such arrangements can involve, for example, battery or other power source heavy chassis modules being coupled in a sideways manner to regularly oriented bedroom or office chassis modules. Similarly, air or gas storage or and/or water storage or treatment chassis may also be rotated and coupled in a sideways manner to regularly oriented chassis to form an overall structure.

Figure 12:
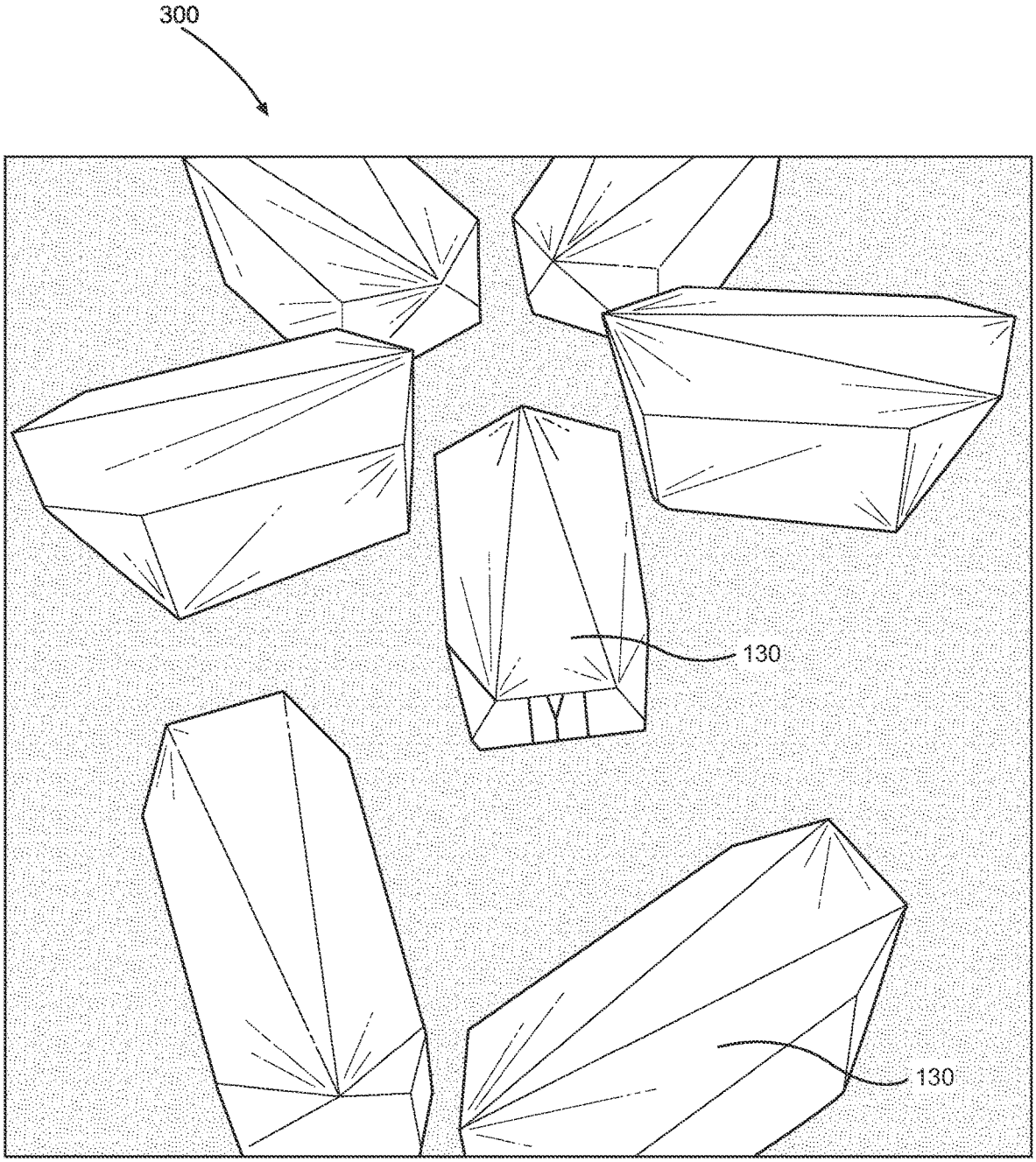
FIG. 12 illustrates in top perspective view an example arrangement of multiple single modular building structures according to one embodiment of the present disclosure.

In some arrangements, multiple modular building structures may be constructed near each other but not interconnected to form larger combined structures. FIG. 12 illustrates in top perspective view an example arrangement of multiple single modular building structures. Arrangement 300 can include multiple single modular building structures assembled and configured into an overall community of structures. Such structures can be arranged in any numbers or patterns to form such a community. For example, star patterns having the back end of each single modular building structure 100 located toward the center of the star pattern and the front doors of each single modular building structure 100 located toward the outside of the star pattern can be used. Other arrangements are also possible, as will be readily appreciated.

In various embodiments, one or more modular building structures can serve as a common unit within a community of other modular building structures. For example, arrangement 300 can include multiple primary structures formed from one or more modular building structures each, such as living or office structures, for example, while one or more other modular building structures can be separate from and provide functionality to some or all of the multiple primary structures in a given community, such as arrangement 300. Such separate modular building structures can be for example, a battery or power source structure, a plumbing or water source structure, an electronics or communication structure, and/or any other of various separate function providing structures. Such one or more separate modular building structures can provide power, plumbing, water, communications, and/or other functions for primary and other modular building structures within the given community of structures.

As one particular example of such a common unit arrangement for an overall community of modular building structures, one or more battery based modular building structures can have an overall power source, power collection components, such as solar panels, for example, and battery ports configured to charge removable battery units. Such a battery based modular building structure can then be used for recharging individual batteries, which batteries can then be transported to other modular building structures within the community for use within those structures. Low or empty batteries in other modular building structures can then be brought to a battery or other power based common unit modular building structure to be recharged and exchanged for full or substantially recharged batteries for further use in the respective other modular building structures in the community of structures.

Similar functions and arrangements can be provided with respect to other aspects of an overall modular building structure community. For example, one or more water based modular building structures can serve as common units for some or all of the other modular building structures in a given community of structures. Empty or low water tanks or containers can then be brought from various modular building structures to a common water based modular building structure and exchanged for water tanks that or full or substantially full of water for later use in their respective structures. Other functions can be similarly served by common units in an overall community, as will be readily appreciated.

Figure 13:
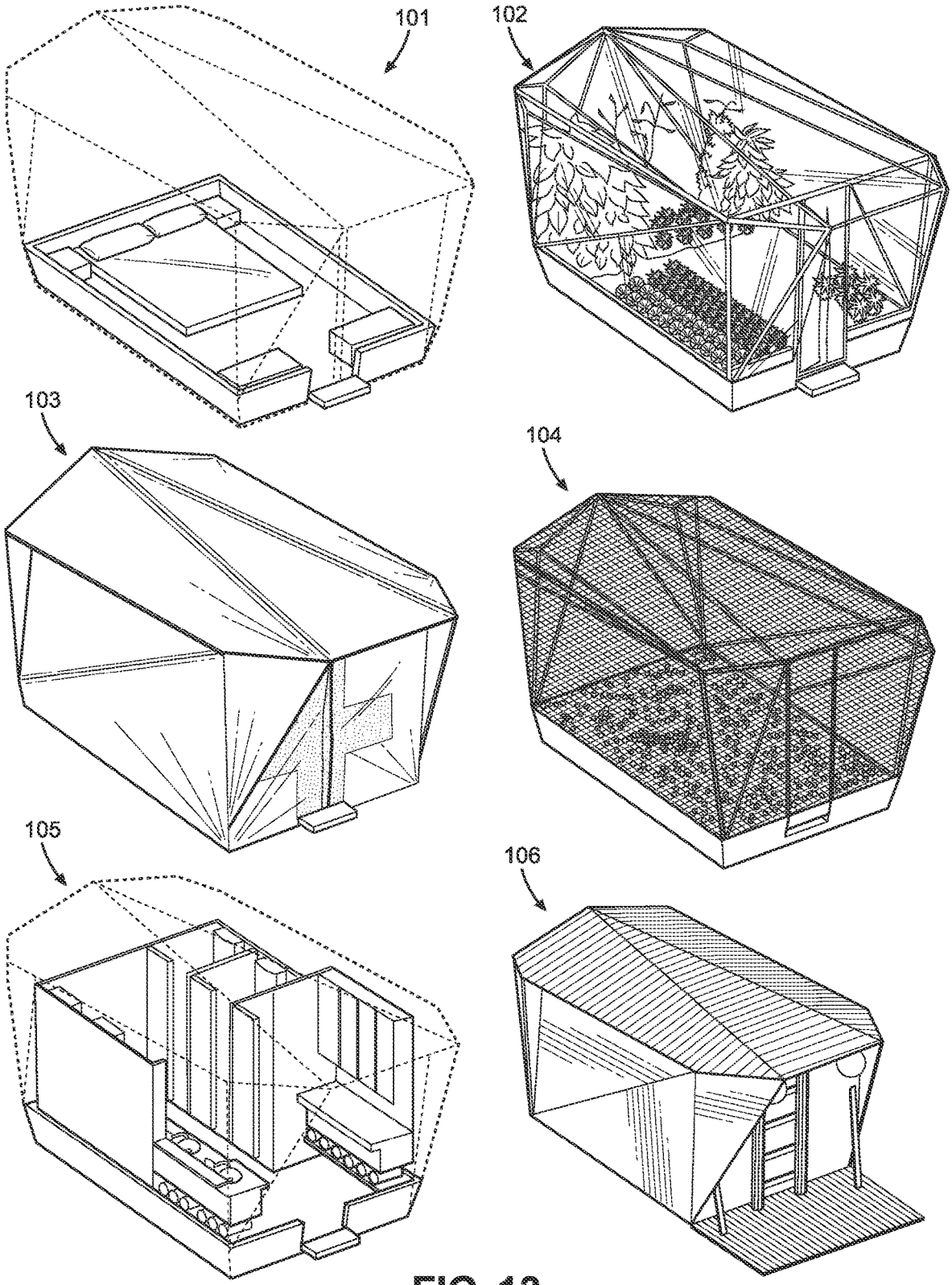
FIG. 13 illustrates in front perspective views examples of various use cases for modular building structures according to various embodiments of the present disclosure.

Turning next to FIG. 13, examples of various use cases for modular building structures are shown in front perspective views. As noted above, it is specifically contemplated that the disclosed modular building structures can have a variety of uses. Such uses can include, for example, a bedroom or other sleeping quarters 101, a greenhouse 102, a first aid or medical facility 103, a ball pit or other indoor playground 104, a bathroom 105, and a cabin 106, among other possible uses and functions.

Figure 14:
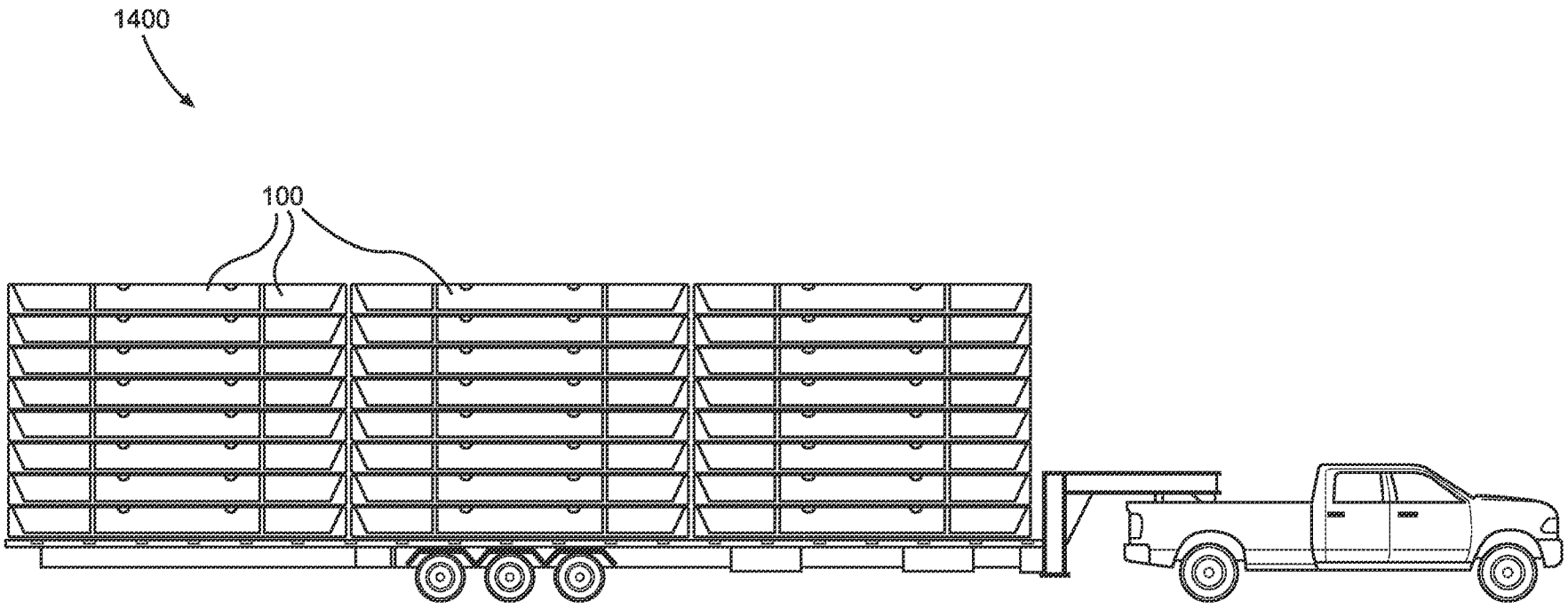
FIG. 14 illustrates in side elevation view an example transport of multiple modular building structures according to one embodiment of the present disclosure.

FIG. 14 illustrates in side elevation view an example transport of multiple modular building structures. Arrangement 1400 can involve multiple disassembled modular building structures 100 stacked together onto a trailer that can then be towed by a truck or other vehicle. As shown, 24 modular building structures 100 are disassembled and contained within their respective chassis and stacked onto the trailer to be towed to a building site. Other amounts, arrangements, and modes of transportation for various types of modular building structures being transported are also contemplated.

Figure 15:
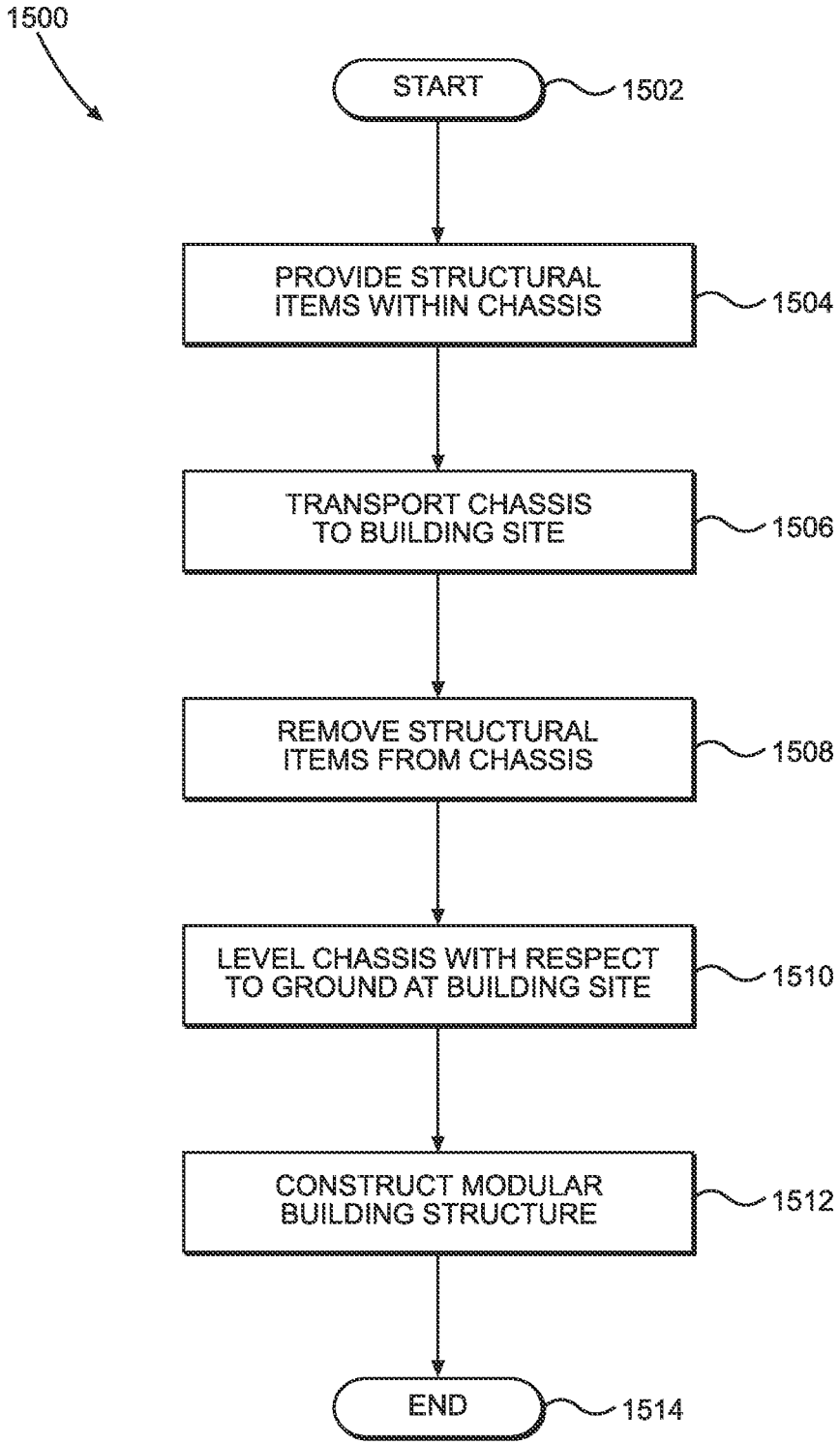
FIG. 15 illustrates a flowchart of an example method of deploying a modular building structure according to one embodiment of the present disclosure.

Lastly, FIG. 15 illustrates a flowchart of an example method of deploying a modular building structure. In various embodiments, method 1500 can be applied using the various systems, devices, and features provided above. After a start step 1502, a first process step 1504 can involve providing structural items of a modular building structure within a self-contained chassis. Such structural items can include vertical support components, one or more wall and roof components, leveling feet, support coupling components, and/or modular coupling components, among other possible structural items.

At a following process step 1506, the chassis can be transported to a building site. This can involve placing the chassis on a vehicle, such as a truck, trailer, ship, plane, or the like, and transporting the chassis to a building site where the modular building structure is to be constructed. In some arrangements, the chassis can be stacked and transported together with multiple other same or similar chassis to the building site.

At a following process step 1508, the structural items can be removed from inside the chassis. This can involve opening one or more storage compartments located within the chassis and removing the structural items therefrom. Opening the storage compartments can involve removing one or more horizontal top panels and/or one or more doors or other openings located along the storage compartments.

At a following process step 1510, the chassis can be leveled with respect to the ground at the building site. This can involve coupling one or more leveling feet to the bottom of the chassis and adjusting the orientation of the one or more leveling feet such that the chassis is leveled with respect to the ground where it is placed.

At the next process step 1512, the modular building structure can be constructed using the removed structural items. This can involve coupling vertical support components to the chassis, coupling the vertical support components to each other, and coupling one or more wall and roof components to the vertical support components, among other possible construction procedures. The method then ends at end step 1514.

It will be appreciated that the foregoing method 1500 may include additional steps not shown, and that not all steps are necessary in some embodiments. For example, additional steps may include arranging or activating one or more functional units, such as an air conditioner, heater, and/or computing system. Other process steps can involve closing the storage compartments after the structural items have been removed, arranging window and/or doors on the modular building structure, and the like. Furthermore, the order of steps may be altered as desired, and one or more steps may be performed simultaneously. For example, step 1510 may be performed prior to or along with step 1508. As another example, process steps 1504 and 1506 can be performed simultaneously, which may take place for the same structure or for multiple structures. Other process steps, details, and arrangements will also be appreciated.

Although the foregoing disclosure has been described in detail by way of illustration and example for purposes of clarity and understanding, it will be recognized that the above described disclosure may be embodied in numerous other specific variations and embodiments without departing from the spirit or essential characteristics of the disclosure. Certain changes and modifications may be practiced, and it is understood that the disclosure is not to be limited by the foregoing details, but rather is to be defined by the scope of the appended claims.

What is claimed is:

1. A modular building structure, comprising:

a rigid chassis having a plurality of storage compartments formed therein, wherein the chassis provides a foundation and floor for the modular building structure;

a plurality of vertical support components configured to be coupled to the chassis and provide a vertical framework for the modular building structure when the modular building structure is assembled, wherein the plurality of vertical support components are also configured to be disassembled from the chassis and stored within one or more of the plurality of storage compartments; and one or more wall and roof components configured to be coupled to the plurality of vertical support components and provide walls and a roof for the modular building structure when the modular building structure is assembled, wherein the one or more wall and roof components are also configured to be disassembled from the chassis and stored within one or more of the plurality of storage compartments.

2. The modular building structure of claim 1, wherein the chassis includes at least one horizontally oriented bottom panel, a plurality of vertically oriented crossbeams situated above the bottom panel, and a plurality of horizontally oriented top panels situated above the crossbeams, wherein the at least one bottom panel, plurality of crossbeams, and plurality of top panels combine to form the plurality of storage compartments.

3. The modular building structure of claim 2, wherein one or more of the crossbeams include at least one opening therein to facilitate storage of the plurality of vertical support components across multiple storage compartments within the chassis.

4. The modular building structure of claim 1, wherein the plurality of vertical support components comprise poles configured to be arranged around a circumference of the chassis.

5. The modular building structure of claim 1, wherein the one or more wall and roof components comprise a flexible material.

6. The modular building structure of claim 5, wherein the one or more wall and roof components are cloth.

7. The modular building structure of claim 1, further comprising:

a plurality of leveling feet coupled to the bottom of the chassis, wherein each of the plurality of leveling feet are configured to allow the chassis to be leveled with respect to the ground where the modular building structure is assembled.

8. The modular building structure of claim 7, further comprising:

a plurality of support coupling components configured to couple the plurality of leveling feet to the chassis, wherein the plurality of support coupling components are also configured to couple the plurality of vertical support components to the chassis.

9. The modular building structure of claim 8, wherein the plurality of support coupling components are square tubes located at outer edges of the chassis.

10. The modular building structure of claim 1, wherein the chassis generally defines a box shape.

11. The modular building structure of claim 10, wherein the chassis is about 8 feet wide by about 13 feet long by about 1.5 feet tall.

12. The modular building structure of claim 1, further comprising:

at least one functional unit located within one or more of the storage compartments, wherein the at least one functional unit is selected from the group consisting of an air conditioner, a heater, a mattress, and a computer.

13. The modular building structure of claim 1, further comprising:

a plurality of modular coupling components configured to couple the modular building structure to a separate similar modular building structure.

14. The modular building structure of claim 13, wherein the modular building structure is configured to function as a bedroom and the separate similar modular building structure is configured to function as an office, a kitchen, or a bathroom.

15. The modular building structure of claim 1, wherein the modular building structure is configured to be stacked with separate similar modular building structures.

16. A method of deploying a modular building structure, the method comprising:

providing structural items of the modular building structure within a plurality of storage compartments located within a rigid and self-contained chassis, wherein the chassis provides a foundation and floor for the modular building structure;

transporting the self-contained chassis to a building site;

removing the structural items from the one or more storage compartments located within the chassis; and constructing the modular building structure by assembling the structural items onto the chassis, wherein the structural items include a plurality of vertical support components and constructing includes coupling the plurality of vertical support components to the chassis.

17. The method of claim 16, wherein the structural items include a plurality of vertical support components that couple to the chassis to provide a vertical framework for the modular building structure and one or more wall and roof components that couple to the plurality of vertical support components to provide walls and a roof for the modular building structure.

18. The method of claim 16, wherein the chassis includes at least one horizontally oriented bottom panel, a plurality of vertically oriented crossbeams situated above the bottom panel, and a plurality of horizontally oriented top panels situated above the crossbeams, wherein the at least one bottom panel, plurality of crossbeams, and plurality of top panels combine to form the one or more storage compartments.

19. The method of claim 16, further comprising the step of:

leveling the chassis with respect to the ground at the building site.

20. The method of claim 19, wherein the structural items include a plurality of leveling feet that are configured to be stored within the one or more storage compartments and that are configured to couple to the bottom of the chassis to allow the chassis to be leveled.

* * * * *